US005206125A

United States Patent [19]

Ogawa

[11] Patent Number: 5,206,125

[45] Date of Patent: Apr. 27, 1993

[54] SILVER HALIDE COLOR PHOTOGRAPHIC MATERIAL

[75] Inventor: Tadashi Ogawa, Kanagawa, Japan

[73] Assignee: Fuji Photo Film Co., Ltd., Kanagawa, Japan

[21] Appl. No.: 611,640

[22] Filed: Nov. 13, 1990

[30] Foreign Application Priority Data

Nov. 14, 1989 [JP] Japan ..... 1-297216

[51] Int. Cl.[5] ..... G03C 1/86

[52] U.S. Cl. ..... 430/507; 430/502; 430/503; 430/510; 430/512; 430/517; 430/570; 430/607; 430/613; 430/950

[58] Field of Search ..... 430/502, 503, 507, 512, 430/542, 567, 570, 950, 599, 510, 512, 513, 517, 607, 613

[56] References Cited

U.S. PATENT DOCUMENTS

| | | | |
|---|---|---|---|
| 4,563,406 | 1/1986 | Ohbayashi et al. | 430/517 |
| 4,564,590 | 1/1986 | Sasaki et al. | 430/553 |
| 4,587,195 | 5/1986 | Ishikawa et al. | 430/513 |
| 4,639,412 | 1/1987 | LaBelle et al. | 430/523 |
| 4,695,531 | 9/1987 | Delfino et al. | 430/513 |
| 4,851,326 | 7/1989 | Ishikawa et al. | 430/567 |

FOREIGN PATENT DOCUMENTS

| | | | |
|---|---|---|---|
| 0327768 | 8/1989 | European Pat. Off. | 430/950 |
| 0387015 | 9/1990 | European Pat. Off. | 430/950 |
| 165656 | 7/1987 | Japan . | |
| 48550 | 3/1988 | Japan . | |

*Primary Examiner*—Hoa Van Le

*Attorney, Agent, or Firm*—Sughrue, Mion, Zinn, Macpeak & Seas

[57] ABSTRACT

A silver halide color photographic material comprising a reflective support and coated thereon at least one each of a cyan dye-forming silver halide emulsion layer, a magenta dye-forming silver halide emulsion layer and a yellow dye-forming silver halide emulsion layer, each of the emulsion layers containing substantially silver iodide-free silver chloride or silver chlorobromide and respectively having spectral sensitivity peaks in different wavelength regions, at least one of the emulsion layers containing silver halide grains having an average grain size of 0.35 μm to 0.65 μm and a silver halide content of 0.19 g $Ag/m^2$ or less, the total silver amount in all the silver halide emulsion layers being 0.78 $g/m^2$ or less, and a water-soluble or bleachable dye being available on the support in such an amount that the sensitivity of the silver halide emulsion layer having a sensitivity peak at the longest wavelength is reduced to 35 to 10% of the sensitivity in the absence of the water-soluble or bleachable dye, the sensitivity of the silver halide emulsion layer having a sensitivity peak at the second longest wavelength is reduced to 50 to 20% of the sensitivity in the absence of the water-soluble or bleachable dye, and the sensitivity of the silver halide emulsion layer having a sensitivity peak at the shortest wavelength is reduced to 70 to 30% of the sensitivity in the absence of said water-soluble or bleachable dye.

11 Claims, No Drawings

SILVER HALIDE COLOR PHOTOGRAPHIC MATERIAL

FIELD OF THE INVENTION

The present invention relates to a silver halide color photographic material. More particularly, the present invention relates to a silver halide color photographic material containing dyed hydrophilic colloid layers with improved qualities such as image sharpness and the ability for rapid processing and low replenishment to be used.

BACKGROUND OF THE INVENTION

In a silver halide photographic material, a photosensitive layer or another layer is sometimes dyed or otherwise colored to insure selective absorption of light in a definite wavelength region.

Light passing through the photosensitive and other layers is sometimes scattered by the silver halide grains, etc. present in the layers or reflected by the interface between the photosensitive layer and the support and/or between the photosensitive layer and the layer disposed on the opposite side and re-enters the photosensitive layer to sensitize the emulsion and form an image in a position shifted from the original position of light incidence. This results in the whole image being blurred or diffused. Also an object of coloring a photosensitive layer is to preclude the above result.

Particularly in a photosensitive material such as a color printing paper wherein a reflective support is employed, the support itself has strong reflectivity to a certain limited degree so that, on exposure, light not absorbed by the photosensitive and other layers tends to be reflected in random directions with high probability and enters the photosensitive layer to sensitize the emulsion and form images in diffused positions other than the proper position of the image formed by incident light. Therefore, in such a photosensitive material, it is a known and common practice to inhibit this image blurring or bleeding by incorporating an appropriate dye in a hydrophilic colloid layer of the material.

On the other hand, another known and important factor in the prevention of image blurring or bleeding is prevention of scattering of incident light by the silver halide grains themselves which are present in the photosensitive layer. The question of the scattering of light by silver halide grains, in addition to its characteristics in photosensitive layers, has been discussed in Mees & James, *The Theory of the Photographic Process*, Fourth Edition, (1966) pages 580–590. Notwithstanding the descriptions in this and other textbooks, it is well known to those skilled in the art that it is advantageous to minimize the coating amount of silver halide grains in the photosensitive layer and since the light scattering characteristics are related to the size of silver halide grains and the wavelength of light, it is advantageous to avoid as much as possible a grain size and a grain size distribution disadvantageous form the standpoint of light scattering. More recently, as disclosed in U.S. Pat. Nos. 4,434,226, 4,439,520, 4,433,048, 4,386,156, 4,399,215 and 4,400,463, etc., use of tabular silver halide grains oriented in parallel with the plane of the photosensitive layer to thereby reduce the irradiation taking place in the photosensitive layer of the silver halide photographic material to a substantial extent has been proposed and, hence, to improve the sharpness of the reproduced image.

Even in a silver halide photosensitive material having a reflective support, too, the light incident on the surface of its photosensitive layer is similarly scattered by the silver halide grains in the photosensitive layer to yield a blurred image with reduced sharpness. Therefore, it appears equally advantageous, even in such a silver halide photosensitive material having a reflective support, to minimize the coating amount of silver halide grains in the photosensitive layer or, on considering light scattering characteristics in relation to the grain size of the silver halide and the wavelength of light, to avoid as much as possible a grain size and a size distribution being disadvantageous from the standpoint of light scattering.

To meet the current demand for rapid processing in the field of photographic materials and/or for low replenishment, efforts are being made to respond to this demand by reducing the coverage of a silver halide emulsion as a photosensitive layer. Such efforts should give rise to advantageous in improving image sharpness.

However, it has been discovered that this is not necessarily true with a silver halide photosensitive material having a reflective support. Thus, it was found that reducing the coating amount of silver halide emulsions in such a material may rather result in decreased sharpness. Therefore, it is important to prevent deterioration of sharpness in such a system and it is important not only to meet the requirements for rapid processing and low replenishment by reducing the coating amount of the silver halide emulsion but also to implement a reduction in production cost by reducing the consumption of silver.

SUMMARY OF THE INVENTION

It is, therefore, a primary object of the present invention to provide a silver halide color photographic material which has improved rapid procession characteristics, which can be used in processing with low replenishment requirements and which provides image sharpness.

The present invention is therefore directed to: (1) a silver halide color photographic material comprising a reflective support and, coated thereon, at least one each of cyan dye-forming, magenta dye-forming and yellow dye-forming layers, each containing substantially silver iodide-free silver chloride or silver chlorobromide and each respectively, having spectral sensitivity peaks in different wavelength regions, at least one of the emulsion layers containing silver halide grains having an average grain size of 0.35 μm to 0.65 μm and a silver halide content of not more than 0.19 g $Ag/m^2$, the total silver amount in all of the silver halide emulsion layers being not more than 0.78 $g/m^2$, and a water-soluble or bleachable dye being available on the support in such an amount that the sensitivity of the silver halide emulsion layer having a sensitivity peak at the longest wavelength is reduced to 35 to 10% of the sensitivity without the water-soluble or bleachable dye, the sensitivity of the silver halide emulsion layer having a sensitivity peak at the second longest wavelength is reduced to 50 to 20% of the sensitivity without the water-soluble or bleachable dye, and the sensitivity of the silver halide emulsion layer having a sensitivity peak at the shortest wavelength is reduced to 70 to 30% of the sensitivity without the water-soluble or bleachable dye.

(2) A silver halide color photographic material according to (1) wherein the reflective support is a support coated with a water-resistant resin layer and/or hydrophilic colloid layer containing at least 13 percent by weight of titanium dioxide based on the total of the resin layer, the hydrophilic colloid layer and titanium dioxide on at least one side thereof.

(3) A silver halide color photographic material according to (1) or (2) wherein the cyan and/or magenta dye-forming silver halide emulsion layer contains a pyrazoloazole coupler.

DETAILED DESCRIPTION OF THE INVENTION

As is generally practiced for reflection-type and direct observation-type photographic materials such as those of the present invention, the photographic layer is preferably dyed with a water-soluble or bleachable dye in view of the fact that the photographic layer comprises a hydrophilic colloid and hence there will be no color residue after processing. From the standpoint of dye incorporation, it is preferable that such a water-soluble or bleachable dye satisfy the following requirements:

(1) An appropriate absorption spectrum depending on the wavelength of light to be absorbed.

(2) Photographically inert, viz. fogging, sensitizing or desensitizing effect, other than optical effects, is not effected on the silver halide emulsion.

(3) Easily washed out of the photographic material or decolorized by a chemical reaction during processing, leaving no color residues in the photographic material after processing.

(4) Stable against temperature, moisture and other environmental factors to which the photographic coating film is subjected, without undergoing change in absorption spectrum or without migration within the coated film.

Dyes meeting the above conditions include many brown dyes and are described below; such as oxonol dyes having a pyrazolone nucleus or a barbituric acid nucleus as described, inter alia, in British Patent Nos. 506,385, 1,177,429, 1,311,884, 1,338,799, 1,385,371, 1,467,214, 1,433,102 and 1,553,516, JP-A-48-85130, JP-A-49-114,420, JP-A-52-20830, JP-A-52-161233 and JP-A-59-111640, (the term "JP-A" as used herein means an "unexamined published Japanese patent application"), U.S. Pat. Nos. 3,247,127, 3,469,985, 3,746,539 and 4,078,933, etc.; other oxonol dyes as described, inter alia, in U.S. Pat. Nos. 2,533,472 and 3,379,533, British Patent No. 1,278,621, West German Patent No. 2,928,184, etc.; azo dyes as described, inter alia, in British Patent Nos. 575,691, 680,631, 599,623, 786,907, 907,125, 1,045,609, 907,125 and 1,045,609, U.S. Pat. No. 4,255,326, and JP-A-59-211043, etc.; azomethine dyes as described, inter alia, in JP-A-50-100116 and JP-A-54-118247, British Patent No. 2,014,598 and 750,031, etc.; anthraquinone dyes as described, inter alia, in U.S. Pat. No. 2,865,752; arylidene dyes as described, inter alia, in U.S. Pat. Nos. 2,538,008, 2,538,009 and 2,688,541, British Patent No. 584,609 and 1,210,252, JP-A-50-40625, JP-A-51-3623, JP-A-51-10927 and JP-A-54-118247, JP-B-48-3286, and JP-B-59-37303 etc. (the term "JP-B" as used herein means an "examined Japanese patent publication"); styryl dyes as described, inter alia, JP-A-28-3082, JP-A-44-16594 and JP-A-59-28898, etc.; triarylmethane dyes as described, inter alia, in British Patents No. 446,583 and 1,335,422, JP-A-59-228250, etc.; and merocyanine dyes as described, inter alia, in British Patents No. 1,075,653, 1,153,341, 1,284,730, 1,475,228 and 1,542,807, etc.

Of these dyes, oxonol dyes having a pyrazolone nucleus are particularly useful in that they are decolorized by a sulfite-containing or hydroxide ion-containing processing solutions and do not exert adversely affect the silver halide emulsions.

Pyrazolone-oxonol dyes are preferably those having the following general formula (A).

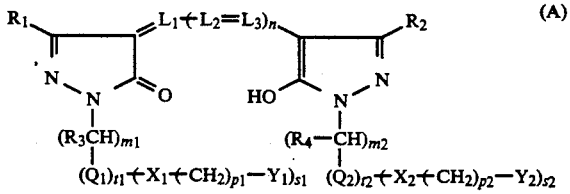

(A)

wherein $R_1$ and $R_2$ each represents —$COOR_5$ or

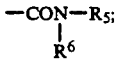

$R_3$ and $R_4$ each represents a hydrogen atom or an alkyl or substituted alkyl group (e.g., methyl, ethyl, butyl, hydroxyethyl, etc.); $R_5$ and $R_6$ each represents a hydrogen atom, an alkyl or substituted alkyl group (e.g., methyl, ethyl, butyl, hydroxyethyl, phenethyl, etc.), or an aryl or substituted aryl group (e.g., phenyl, hydroxyphenyl, etc.); $Q_1$ and $Q_2$ each represents an aryl group e.g., phenyl, naphthyl, etc.); $X_1$ and $X_2$ each represents a bond or a divalent linking group; $Y_1$ and $Y_2$ each represents a sulfo group or a carboxyl group; $L_1$, $L_2$ and $L_3$ each represents a methine group; $m_1$ and $m_2$ each represents 0, 1 or 2; n means 0, 1 or 2, $p_1$ and $p_2$ each represents 0, 1, 2, 3 or 4; $s_1$ and $s_2$ each means 1 or 2; $t_1$ and $t_2$ each represents 0 or 1; provided, however, that $m_1$, $p_1$ and $t_1$ or $m_2$, $p_2$ and $t_2$ are not Simultaneously equal to 0.

Dye compounds which are particularly suitable for the purposes of the present invention are shown below. It should, of course, be understood that these dyes are merely illustrative and not limitative of the dyes usable in the present invention.

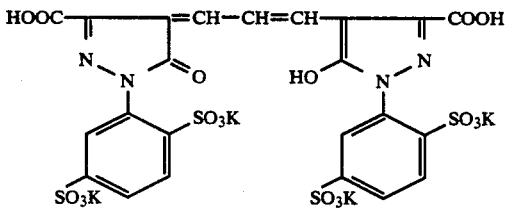

(A-I)

-continued
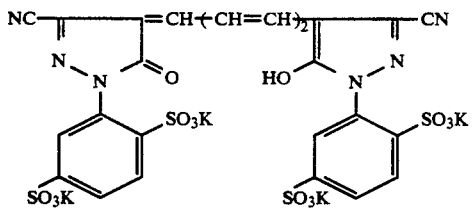
(A-II)
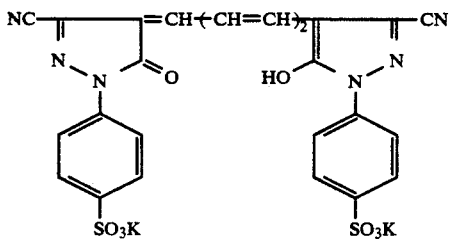
(A-III)
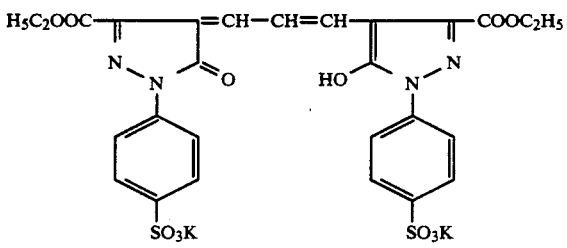
(A-IV)
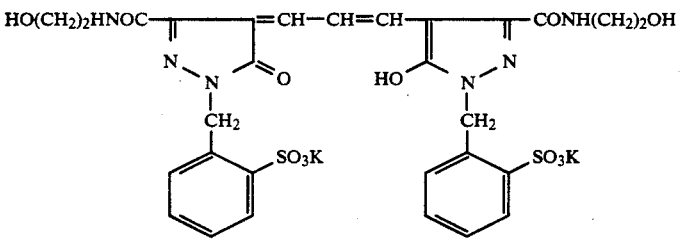
(A-V)
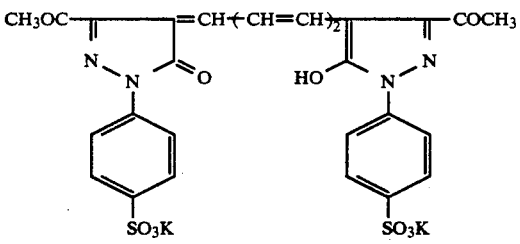
(A-VI)
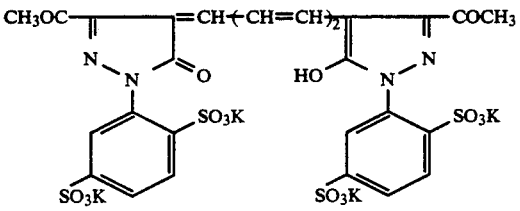
(A-VII)

-continued

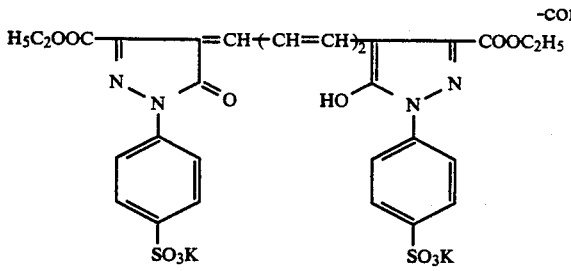

(A-VIII)

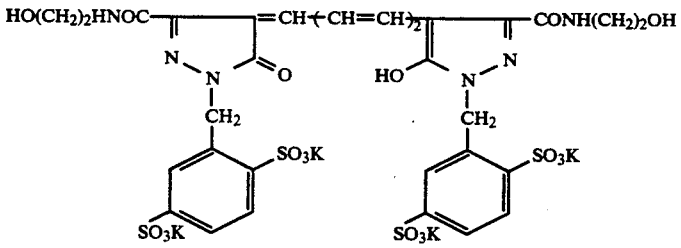

(A-IX)

In the present invention, the coating amount of the water-soluble or bleachable dye must be such that, when compared with the sensitivities in the absence of such a dye in the photographic layer of a silver halide color photographic material, the sensitivity of the silver halide emulsion layer having a spectral sensitivity peak at the longest wavelength is reduced to 35 to 10%, that of the silver halide emulsion layer having a sensitivity peak at the second longest wavelength is reduced to 50 to 20% and that of the silver halide emulsion layer having a sensitivity peak at the shortest wavelength is reduced to 70 to 30%. To achieve these sensitivities, a single kind of dye may be employed or, alternatively, two or more kinds of dyes can be used in combination. The preferred practice is using three or more kinds of dyes to independently set the sensitivities of the respective dye-forming layers with different spectral sensitivities to the necessary levels. For example, when the photosensitive layers are red-, green- and blue-sensitive layers, a cyan, a magenta and a yellow dye, respectively, can be used.

If the amounts of dyes are too small to reduce the sensitivities of these silver halide emulsion layers to at least 35%, 50% and 70%, respectively, the improvement in sharpness is not obtained in a low-silver halide photosensitive material such as that of the invention. Conversely, if the amount of dye is so large as to reduce the sensitivity of any one of the silver halide emulsion layers to less than 10%, 20% or 30% of the sensitivity in the absence of the dye, the resultant improvement in sharpness is more than offset by adverse effects due to an excessive decrease in the sensitivity of the photosensitive material overall and the balance of sharpness among the respective layers is also disturbed resulting in color bleeding and, hence, a decrease in apparent sharpness.

Dyeing the photographic layer in the system of the present invention has resulted in an improvement in sharpness far greater than predictable from the experience of dyeing of a photographic system in which a reduced coating amount of a silver halide emulsion is conductive to an improvement in sharpness.

In other words, the practice of reducing the amount of silver which is generally known to favor sharpness actually results in just the opposite, such as the system of the present invention, where a silver halide emulsion containing silver halide grains having a certain grain size is coated in a small amount on a reflective support. This is a surprising finding which is hardly predictable from current knowledge.

The reason why the sharpness is generally improved when the coating amount of a silver halide emulsion is decreased is that light incident on a silver halide emulsion layer is scattered by the silver halide emulsion grains themselves to blur the light reaching the emulsion layer closer to the support.

The above situation does not prevail in the system of the present invention because of the following. Thus, the decrease in sharpness which occurs when a silver halide emulsion having a grain size within a specific range is coated with a small silver coverage amount is relevant to the fact that, because of the low silver coverage, the proportion of incident light absorbed by the silver halide emulsion or the sensitizing dye adsorbed on the emulsion grains is so small that much of the light passing through the silver halide emulsion layer and reaching the surface of the reflective support is randomly reflected by the support, as a result, of this reflected light, the portion of light scattered in directions of advance substantially parallel to the surface of the support is not rescattered or absorbed by the emulsion of defined grain size but allowed to advance over a long distance to be ultimately absorbed at positions away from the original position of incidence of light.

The effects of the present invention suggest that when the silver amount is large, the abovedescribed distance of travel of light is so short as to act favorably for sharpness, while then the silver coverage is small, the proportion of contribution to the shortening of said distance due to a dye is increased to bring about the above-described characteristic result.

Therefore, in order to provide a silver halide color photographic material according to the invention, it is essential to insure that the silver halide emulsion in at least one of the multiple emulsion layers has an average grain size of 0.35 $\mu$m to 0.65 $\mu$m and that the Ag amount of this particular silver halide emulsion layer is not more than 0.19 g/m$^2$.

Furthermore, the silver halide color photographic material of the present invention provides still more desirable effects when the total amount of silver halide in all the silver halide emulsion layers is not more than 0.78 g $Ag/m^2$ as silver.

The effects of the invention are hardly achieved when the average grain size of at least one silver halide emulsion layer is not within the range of 0.35 μm to 0.65 μm, i.e., when the average grain sizes of silver halide emulsions in all the layers are either smaller than 0.35 μm or larger than 0.65 μm. Furthermore, the effects of the invention are scarcely observed when the amount of silver halide in the layer formed from a silver halide emulsion having such an average grain size is more than 0.19 g $Ag/m^2$. Moreover, the effects of the invention are not fully accomplished when the total amount of silver halide in all of the silver halide emulsion layers exceeds 0.78 g $Ag/m^2$.

All of the above requirements are apparently associated with the phenomenon that in a system using a silver halide emulsion having a grain size which tends to cause a large scattering of incident light, the distance of travel of scattered light is markedly increased in a certain direction when the coating amount of such a silver halide emulsion is decreased.

While the average grain size of a silver halide emulsion which markedly contributes to the effects of the invention is 0.35 μm to 0.65 μm, the effects of the invention are more easily achieved when the average grain size lies within the range of 0.40 μm to 0.60 μm. Moreover, the effects of the invention can be obtained with greater facility when a silver halide emulsion having an average grain size of 0.35 μm to 0.65 μm exists in two layers rather than in one layer and the effects are still even more pronounced when a plurality of the emulsions have the above characteristics. The effects are maximized when all of the silver halide emulsion layers satisfy these requirements. For the purposes of the present invention, it is preferable for at least two emulsion layers to have an average grain size of 0.35 μm to 0.65 μm. In this case, too, it is sufficient for the silver coverage of either one of the plural silver halide emulsion layers to be not more than 0.19 $g/m^2$, although it is preferable for the silver amount of the other emulsion layer or layers having an average grain size of 0.35 μm to 0.65 μm to be also not more than 0.19 $g/m^2$.

While it is sufficient for any one of the silver halide emulsion layers having an average grain size of 0.35 μm to 0.65 μm to have a silver amount of not more than 0.19 $g/m^2$, the silver amount is preferably not more than 0.16 $g/m^2$ and more desirably not more than 0.13 $g/m^2$.

To accomplish the objects of the invention to the fullest extent, it is necessary to ensure that the total amount of silver in all the silver halide emulsion layers is not more than 0.78 $g/m^2$ as described hereinbefore but the total amount of silver is preferably not more than 0.72 $g/m^2$ and, for still better results, not more than 0.66 $g/m^2$. The most desirable coating amount is not more than 0.62 $g/m^2$ as silver. The effects of the invention are more pronounced when the total amount of silver is still smaller but it is difficult at the present to further-reduce the silver coverage in a system wherein a primary amine color developing agent is oxidized with the silver halide per se and the resulting oxidation product reacts with a coupler to provide a color image. However, the amount of silver may be decreased, for example, by the so-called complement technique (specifically, the hydrogen peroxide complement system) and a silver coverage of as low 0.2 $g/m^2$ can be used. In such a system, too, the present invention exhibits remarkable effects.

In order to reduce the silver amount in a given silver halide emulsion layer to a level not exceeding 0.19 $g/m^2$ or the total silver amount to a level not exceeding 0.78 $g/m^2$ in the present invention, it is advantageous to use a 2-equivalent coupler as the color-forming coupler. Particularly, as a magenta coupler, a pyrazolone 2-equivalent coupler is desirable but the use of a pyrazoloazole 2-equivalent coupler described hereinafter is very advantageous in that the silver coverage can be reduced because of its high equivalency and color-forming efficiency. With regard to the cyan coupler, too, the use of a pyrazoloazole coupler is advantageous in that the coating amount of silver can be minimized. Therefore, in the present invention it is preferable to use pyrazoloazole 2-equivalent couplers as the magenta and/or cyan coupler.

In the present invention, the cyan dye-forming silver halide emulsion layer, magenta dye-forming silver halide emulsion layer and yellow dye-forming silver halide emulsion layer have spectral sensitivity peaks in different wavelength regions but the sensitivity of the silver halide emulsion layer having a spectral sensitivity peak at the longest wavelength of all of the silver halogen emulsion layers should be such that it will be reduced to 35% to 10%, preferably to not more than 25% and more desirably to not more than 20% by the above water-soluble or bleachable dye.

The sensitivity of the silver halide emulsion layer having a spectral sensitivity peak at the second longest wavelength should also be such that the water-soluble or bleachable dye will reduce the sensitivity to 50 to 20%, preferably to not more than 40% and, for still better results, to not more than 35% of the original sensitivity.

The silver halide emulsion layer having a spectral sensitivity peak at the shortest wavelength should also be such that the water-soluble or bleachable dye will reduce its sensitivity to 70 to 30%, preferably to not more than 50% and, for still better results, to not more than 40% of the original sensitivity.

Decreasing the sensitivity of only one or two of the multiple emulsion layers to levels outside of the above-mentioned sensitivity ranges is not desirable from the standpoint of interlayer sharpness balance.

The reflective support is important in the present invention. The effects of the invention are less marked when an antihalation layer is present on the support. In other words, the reflectivity of the surface of the support is preferably as high as possible. This means that it is good practice to dispose a reflective layer on the support.

The support to be used in the present invention may have a cover layer formed from a water-resistant resin in which finely divided titanium dioxide has been dispersed in a proportion of not less than 10 percent by weight. The cover layer may likewise be formed from a hydrophilic colloid coating composition containing not less than 10 percent by weight of finely divided titanium dioxide. The proportion of titanium dioxide is preferably not less than 13 percent by weight and, for still better results, not less than 15 percent by weight. In the case that multiple layers of water-resistant resin layer or hydrophilic colloid layer containing the titanium dioxide are used, at least one layer should contain not less than 13% by weight of titanium dioxide.

Finely divided titanium dioxide used is preferably surface-treated with an inorganic oxide such as silica or aluminum oxide and a dihydric to tetrahydric alcohol such as 2,4-dihydroxy-2-methylpentane and trimethylolethane which are described in JP-A-58-17151, either simultaneously or separately. The water-resistant resin or hydrophilic colloid layer containing the finely divided titanium dioxide dispersed therein may have a thickness in the range of 2 μm to 200 μm and preferably 5 μm to 80 μm.

A plurality of water-resistant resin or hydrophilic colloid layers containing varying amounts of finely divided titanium dioxide can also be employed. When a plurality of water-resistant resin or hydrophilic colloid layers are used in combination, it is recommended to insure that the percentage of finely divided titanium dioxide present in the layer most distant from the support is, relatively, higher than that in a layer closer to the support.

The dispersibility of finely divided titanium dioxide in the water-resistant resin or hydrophilic colloid layer, that is to say the coefficient of variation in the percentage area where finely divided titanium dioxide particles are present relative to a unit surface area of the support, is preferably not higher than 0.20, more desirably not higher than 0.15 and, for still better results, not higher than 0.10.

The degree of dispersibility of the finely divided titanium dioxide or, more specifically, the coefficient of variation in the percentage area where titanium dioxide particles are present can be determined by removing the surface of the resin or colloid layer to a depth about 0.1 μm, preferably about 0.05 μm, by ion sputtering using the glow discharge method, observing the exposed particles of titanium dioxide electron-microscopically, and measuring the total area on the microphotograph where titanium dioxide particles are present. The ion sputtering technique which can be used is described in detail, inter alia, in Yoichi Murayama and Kunihiro Kashiwagi: *Plasma Technology in Surface Treatment*, Kikai-no-Kenkyu 33, 6, 1981.

A recommended procedure for controlling the coefficient of variation in the relative area where titanium dioxide particles are present to a value not higher than 0.20 comprises mixing finely divided titanium dioxide thoroughly into the matrix in the presence of a surfactant. Moreover, it is preferable for the finely divided titanium dioxide to be subjected to the above-described surface treatment using a dihydric to tetrahydric alcohol.

The relative area where finely divided titanium dioxide are present per given unit area can be most typically determined by dividing the observation field into adjoining square unit areas of 6μm×6 μm and measuring the relative projected area Ri where particles in that unit area are present.

The coefficient of variation in the relative area Ri can be calculated as s/R where R is the mean of Ri and s is the standard deviation of Ri. The number n of unit areas is preferably not less than 6. Thus, the coefficient of variation can be calculated in accordance with the following formula.

$$\left[\sum_{i-1}^{n} (Ri - R)/(n-1)\right] / \left[\left(\sum_{i-1}^{n} Ri\right)/n\right]$$

The finely divided titanium dioxide may be rutile type or the anatase type titanium dioxide. In addition, titanium dioxide, other white pigments such as barium sulfate, calcium sulfate, zinc oxide, silicon oxide, titanium phosphate, aluminum oxide, etc. can be used alone or in combination with titanium dioxide.

The reflective support to be employed in the present invention may be a substrate covered with a water-resistant resin or a hydrophilic colloid. Examples of suitable substrates are base papers prepared from natural pulp, synthetic pulp or a mixture thereof and various synthetic resin films such as polyester film (e.g. films of polyethylene terephthalate, polybutylene terephthalate, etc.), cellulose triacetate film, polystyrene film; polypropylene film and so on.

The reflectance of the support is determined primarily by the total amount of titanium dioxide per unit area in the resin layer and the hydrophilic colloid layer of the support, and supplementally by the reflectance of the support substrate itself and colored substances.

The base papers can be selected from among those which are commonly used as photographic printing papers. These materials are prepared from natural pulps available from various soft (coniferous) woods and hard (broad-leaved) woods and supplemented with appropriate fillers such as clay, talc, calcium carbonate, finely divided urea-formaldehyde resin, etc., sizing agents such as rosin, alkyl ketene dimers, higher fatty acids, paraffin wax, alkenyl succinate, etc., paper reinforcing agents such as polyacrylamide, and fixing agents such as aluminum sulfate, cationic polymers and so on. Particularly preferred is a neutral paper of pH 5 to 7 which has been treated with a reactive size such as an alkyl ketene dimer or alkenyl succinate. The pH of the paper can be measured with a pH meter using a flat electrode GST-5313F available from Toa Dempa Industries, Ltd. Neutral paper includes papers with pH values not less than 5 and preferably in the range of 5 to 9.

The pulp may be a natural pulp or a synthetic pulp. The pulp may be surface-sized with a film-forming polymer such as gelatin, starch, carboxymethylcellulose, polyacrylamide or polyvinyl alcohol or a modification product thereof. Examples of modified polyvinyl alcohols are carboxyl-modified PVA, silal-modified PVA and a copolymer of vinyl alcohol and acrylamide. The coating amount of the film-forming polymer for surface sizing is controlled to 0.1 to 5.0 g/m$^2$ and preferably 0.5 to 2.0 g/m$^2$. The film-forming polymer used for this purpose may contain an antistatic agent, fluorescent whitener, pigment, anti foaming agent and so on.

The base paper is manufactured by processing a slurry of the pulp, optionally supplemented with appropriate amounts of said filler, size, paper resin-forcing agent, fixing agent, etc., using a paper-making machine such as a Fourdrinier board machine or the like, drying the resulting web and taking it up. The surface sizing mentioned above can be carried out either before or after drying. In addition, a calendering step is generally interposed between the drying and take-up steps. When surface sizing is performed after the drying step, the calendering can be performed either before or after surface sizing.

In the present invention, the water-resistant resin may be a support, per se as is the case with polyvinyl chloride. The water-resistant resin, in the context of the present invention, is any resin whose water absorption ratio is not more than 0.5 and preferably not more than 0.1 based on a weight, including, inter alia, polyalkylene (e.g., polyethylene, polypropylene, and corresponding copolymers), vinyl polymers (e.g., polystyrene, polyacrylate, and their corresponding copolymer), and polyesters and their corresponding copolymers. Polyalkylene resins such as low-density polyethylene, high-density polyethylene, polypropylene and various blends thereof are preferred. If necessary, a fluorescent whitener, antioxidant, antistatic agent, release agent, etc. may be added.

As pointed out in JP-A-57-27257, JP-A-57-49946 and JP-A-61-262738, unsaturated organic compounds containing at least one polymerizable carbon-carbon double bond per molecule, such as methacrylic ester compounds and the di-, tri- or tetra-acrylic esters described in JP-A-61-262738, can be employed. In this case, the monomer is coated on a substrate and then cured by irradiation with an electron beam to produce the necessary water-resistant resin layer.

In the present invention, the hydrophilic colloid layers can comprise gelatin, for instance. In addition to gelatin, polyvinyl alcohol and polyacrylic acid can likewise be employed. These may be used in admixture with gelatin, if desired.

The techniques which can be exploited for the formation of such a water-resistant resin layer in the present invention include various lamination techniques, such as dry lamination, solvent-less dry lamination, etc., which are described, inter alia, in *Handbook of New Lamination Technologies* edited by Kako Gijutsu Kenkyukai (Processing Technology Research Association) (1983) as well as coating techniques including the gravure roll method, the wire bar method, the doctor blade method, the reverse roll method, the dip method, the air-knife method, the calender method, the kiss method, the squeeze method, the fountain coating method and so on. The hydrophilic colloid layer can also be formed in the same manner as above. In addition the hydrophilic colloid layer is concerned, it can be formed at the same time as the formation of a photosensitive layer on the support.

The surface of the support is preferably subjected to a corona discharge, glow discharge or flame treatment. The total thickness of the support inclusive of the reflective layer is preferably 30 to 400 μm and the total weight thereof is preferably in the range of 30 g/m$^2$ to 350 g/m$^2$ and, for still better results, 50 g/m$^2$ to 200 g/m$^2$.

The halogen composition of the silver halide emulsions for use in the formation of the photosensitive layers in the silver halide color photographic material of the present invention may be any of silver chloride, silver chlorobromide, silver chloroiodobromide and silver chloroiodide, but it is preferable that there be substantially no silver iodide. That is, the content of silver iodide is not more than 1 mol %, preferably not more than 0.3 mol %, more preferably not more than 0.1 mol % and most preferably no silver iodide being contained. Silver chloride or a chlorobromide rich in silver chloride is preferred to achieve rapid processing. More desirable is silver chloride emulsion or a silver chlorobromide emulsion containing not less than 96 mol % of silver chloride is more preferred. In case silver bromide is present, it preferably exists as a local phase within the grain or on the surface of the grain. Here, the presence of at least one localized partial structure having a high silver bromide content in the core or on the surface of the silver halide grain is referred to a local phase. In pure silver chloride, too, the presence of a localized partial structure with a different proportion of metal ions other than silver ion, such as iridium, rodium, iron, etc., is also referred to a local phase.

When the silver halide grain is composed of silver chlorobromide as in the present invention, it is preferably a silver chlorobromide having a mean silver chloride content of not less than 96 mol % and a local phase with a silver bromide content exceeding 15 mol %. The topology of such a local phase having such a high silver bromide content can vary depending on the characteristics desired in the particular emulsion and may exist in the core of the grain, on the surface of the grain or close to the surface and even in a plurality of such locations. Furthermore, the local phase, whether located in the core of the grain, on the surface of the grain or close to the grain surface, may be in a stratified structure surrounding the grain or in a discontinuous isolated structure, or even in a mesh-like structure or in a composite structure.

One of the preferred topologies of such a local phase is the localization of a silver chlorobromide having a silver bromide content of at least 15 mol % on the surface of the silver halide grains. It should be understood that the silver bromide content of the localized phase is preferably more than 15 mol % as mentioned above but that it should not exceed 70 mol %. If the silver bromide content is too large, various disadvantageous effects tend to occur. Thus, for example, pressure desensitization, that is the desensitization which occurs to light exposure after application of a mechanical pressure to a photosensitive material prepared using such an emulsion, may become excessive or the photographic properties of the photosensitive material will be markedly affected by changes in the composition of the processing baths.

Therefore, the silver bromide content of the localized phase is preferably 15 to 70 mol %, more desirably 20 to 60 mol % and, for still better results, 30 to 50 mol %.

The local phase preferably contains silver in a proportion of 0.01 to 20 mol %, preferably 0.02 to 7 mol %, of the total amount of silver forming the silver halide grain.

The interface between such a silver bromide-rich localized phase and the remaining phase of the silver halide grain may form a distinct borderline or a boundary region showing a gentle gradation of halogen content.

The silver bromide content of such a silver bromide-rich localized phase can be determined by X-ray diffraction analysis (cf. *The Chemical Society of Japan* ed.): *Shin Jikken Kagaku Koza* (*New Experimental Chemistry Series*), VI Structural Analysis, Maruzen) or the XPS method (cf. *Surface Analysis -IMA, Application of Auger Electron-Photoelectron Spectrometry,* Kodansha), for instance, and can be determined electron microscopically.

A diversity of methods can be used for the formation of a silver bromide localized phase or a metal salt localized phase in the practice of the present invention. For example, such a localized phase can be formed by reacting a soluble silver salt with a soluble bromide or metal salt using the single-jet method or the double-jet method. The localized phase can also be formed by the so-called halogenconversion method including a step of converting a preformed silver halide to a silver halide with a smaller solubility product. Alternatively, the localized phase can be formed by mixing and ripening preformed silver halides differing in halogen composition to cause recrystallization to occur. For the formation of a silver chlorobromide localized phase on the surface of the silver chloride grains, it is preferable to let the localized phase formed by adding silver bromide grains be smaller than the preformed silver chloride grains and then ripening the mixture to cause recrystallization.

The degree of halogenconversion or recrystallization and, for that matter, the characteristics of the emulsion can be freely controlled by varying the timing of addition of the halide solution, addition of insoluble halide, addition of the silver salt solution and halide solution, addition of relatively small silver halide grains, the ripening time and temperature, the duration of addition, the silver ion concentration during ripening and other conditions.

An emulsion having such a localized phase may contain silver iodide but the silver iodide is preferably localized. In the present invention, the silver iodide content is preferably 0 to 3 mol %, more desirably in the range of 0 to 1 mol % and, for still better results, in the range of 0 to 0.6 mol %.

The silver halide emulsion to be used in accordance with the present invention may contain, in addition to silver halides, other inorganic silver salts such as silver rhodanide, silver phosphate and so on.

The crystal shape of the silver halide emulsion according to the present invention may be regular, e.g., cubic, octahedral tetradecahedral of rhombododecahedral, or irregular, e.g. spherical or tabular. Grains having more complicated configuarations such as composites of various crystal planes or having higher orders of crystal planes may also be employed. Furthermore, these diverse silver halide grains may be present in combination, if desired.

Emulsions of tabular grains having an average aspect ratio (ratio of the diameter of the dominant face, converted into a circle, of the grain/the thickness of the grain) of 5 or more, preferably 8 or more, accounts for not less than 50% of the total projected area of the grains are advantageous for rapid processing.

While the size distribution of silver halide grains may be broad or narrow, the so-called monodisperse emulsion has superior sensitivity stability.

The S/d value, which is the value obtained by dividing the standard deviation S of the distribution of the diameters of the projected areas, converted into circles, of the silver halide grains by the average diameter d, is preferably not more than 20 percent and, for still better results, not more than 15%.

The silver halide emulsions which can be advantageously employed in the present invention are monodisperse emulsions containing silver halide grains having regular crystal shapes in a proportion of not less than 50%, more preferably not less than 70%, and for still better results, not less than 90%, by number or by weight: Particularly preferred are emulsions of cubic or tetradecahedral silver halide grains having (100) faces and containing the localized phase mentioned hereinbefore in positions corresponding to the corners or edges of a cube. With regard to the localized phase composed of metal salts, it is preferably present at positions other than the edges or corners, such as (100) faces in the present invention. Such discontinuous or isolated localized phases present on the surface of the silver halide grain can, for example, be formed by the halogenconversion technique which comprises supplying bromide or metal ions to an emulsion containing base silver halide grains while controlling the silver ion concentration, hydrogen ion concentration and temperature and/or time. In this procedure, when the ions should be uniformly distributed in the respective grains within the system, it is preferable to supply the ions under thorough stirring of the system. It is also an advantageous procedure to supply ions at low concentrations or gradually. As a means for such gradual supply, an organic halogen compound such as bromosuccinimide, bromopropionic acid or the like or a halogen compound encapsulated in a semi-permeable film may be employed.

The localized phase may also be formed by supplying silver and halogen ions to an emulsion containing base silver halide grains while the silver ion concentration and the like are controlled so as to induce growth of the silver halide at a defined position on or within the grain or introducing silver halide crystals finer than the base silver halide grains so as to cause growth of the desired silver halide by recrystallization at a defined position, such as the edges or corners of the base silver halide grain. In this case, a silver halide solvent may be used in combination.

Furthermore, the halogenconversion or recrystallization-controlling agents described in JP-A-62-263318, JP-A-62-329265 and JP-A-63-7861 can also be used in combination and it is also possible to use crystals of silver iodobromide, silver chlorobromide, etc. as the crystals of silver bromide.

The grain size of the silver halide crystals present in the silver halide emulsion to be used in the present invention is preferably between 0.05 μm and 2 μm and more desirably between 0.1 μ and 1.5 μ, in terms of the diameter of a sphere of comparable volume.

The silver halide emulsion to be used in accordance with the present invention can be prepared by the methods described in P. Glafkides: *Chemie et Phisique Photographique,* Paul Montel, 1967, G. F. Duffin: *Photographic Emulsion Chemistry,* Focal Press, 1966, V. L. Zelikman et al.; *Making and Coating of Photographic Emulsion,* Focal Press, 1964 and other literature.

Thus, the method of preparation may be any of the acid process, the neutral process, the ammonia process and so on but, as far as the present invention is concerned, the acid process and the neutral process are particularly preferred in that fogging is thereby minimized. To achieve a high sensitivity, the emulsion is preferably prepared at a lower hydrogen ion concentration than a neutral. Moreover, when the silver halide emulsion is to be prepared by reaction of a soluble silver salt with a soluble halide, any of the single-jet method, the double-jet method or a combination thereof can be employed. The reverse-jet method in which grains are formed in the presence of an excess of silver ions can also be employed. In order to obtain a monodisperse emulsion which is desirable for the purposes of the present invention, the double-jet method is preferred. One mode of double-jet mixing comprises the controlled double-jet method in which the silver ion concentration in the liquid phase giving rise to silver halide is held constant and this method is particularly preferred. By this method, a silver halide emulsion which is suited for the purposes of the present invention, that is to say an emulsion having a regular silver halide crystal shape and a narrow grain size distribution, can be obtained.

In the course of formation of silver halide grains or physical ripening, substances such as cadmium salts, zinc salts, lead salts, thalium salts, or irridium salts or complex salts thereof, rhodium salts or complex salts thereof, and iron salts or complex salts thereof may be present in the system.

During or after the formation of the grains, a silver halide solvent (e.g. ammonia, thiocyanates, and the thioethers and thiones mentioned in U.S. Pat. No. 3,271,157, JP-A-51-12360, JP-A-53-82408, JP-A 53-144319, JP-A-54-100717 or JP-A-54-155828) can be added and when such a silver halide solvent is used concomitantly with the above technology a silver halide emulsion particularly suitable for the purposes of the invention, that is to say an emulsion having a regular silver halide crystal shape and a narrow grain size distribution can be obtained.

Removal of soluble salts from the physically ripened emulsion can be effected by any of noodling, flocculation-precipitation and ultrafiltration techniques, to name but a few.

The emulsion to be used in the present invention can be chemically sensitized by sulfur sensitization, selenium sensitization, reduction sensitization and/or noble metal sensitization. Thus, the sulfur sensitization method using active gelatin or a sulfur compound capable of reacting with silver ion (such as a thiosulfate, a thiourea compound, a mercapto compound or a rhodanine compound), the reduction sensitization method using a reducing substance (such as stannous salts, amines, hydrazine derivatives, formamidine-sulfinic acid, silan compounds, ascorbic acid, etc.), and the noble metal sensitization method using a metal compound (e.g., the above described metal salts and salts or complex salts of metals of Group VIII of the Periodic Table of the Elements, such as platinum, iridium, palladium, rhodium, iron, etc.) can be used alone or in combination. For the emulsion of the present invention, sulfur sensitization or selenium sensitization is preferred and it is also an advisable procedure to use gold sensitization in combination therewith. Furthermore, for the purpose of controlling sensitivity and gradation, it is preferable to conduct the chemical sensitization in the presence of a hydroxyazaindene compound or a nucleic acid.

The incorporation of metal ions other than silver ions (such as the metal ions of Group VIII, transition metal ions of Group II, lead ion of Group IV, gold and copper ions of Group I of the Periodic Table of the Elements) or the corresponding complex ions in the silver halide grains according to the invention is beneficial to insure that the sensitivity stabilizing effects of the invention can be achieved under a diversity of conditions. These metal ions or complex ions may be incorporated throughout the silver halide grain, the above-described localized phase, or any other locality within the grain.

Of the above-described metal ions or complex ions, iridium ion, palladium ion, rhodium ion, zinc ion, iron ion, platinum ion, gold ion and copper ion are particularly useful. The combined use of such metal ions and/or complex ions leads to more desirable photographic characteristics than the independent use of any one of them in many instances and it is preferable to vary the ion species and level of addition between the localized phase and the remainder of the grain. Particularly, iridium and rhodium ions are preferably incorporated in the localized phase.

To incorporate the metal ions and/or complex ions in the localized phase or the remaining phase of the silver halide grain, such metal ions and/or complex ions can simply be added directly to the reaction vessel before, during or after (that is to say during physical ripening) the formation of silver halide grains or previously adding them to the solution containing the water-soluble halogen salt or water-soluble silver salt to be used for the formation of silver halide grains. The procedure which can be followed to form the localized phase of fine silver bromide particles comprises incorporating into fine silver bromide or silver iodide grains in the above manner and adding the mixture to a silver chloride or silver chloride-rich emulsion. It is also possible to use rather sparingly soluble bromides of metal ions, such as those described above, other than the silver salt, in a solid or powdery form to thereby incorporate the metal ions in parallel with the formation of the localized phase. The emulsion obtained by any of the foregoing techniques fully exhibits the characteristics of the high-silver chloride emulsion in the present invention.

The use of spectral sensitizing dyes is important in the present invention. Spectral sensitizing dyes which can be used in the present invention include cyanine dyes, merocyanine dyes, compound merocyanine dyes and so on. In addition to these dyes, compound cyanine dyes, holopolar cyanine dyes, hemicyanine dyes, styryl dyes and hemioxonol dyes can be employed. Preferred cyanine dyes are simple cyanine dyes and carbocyanine dyes. These cyanine dyes can be expressed by the following general formula (I).

General Formula (I)

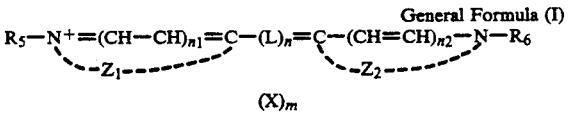

wherein L represents a methine group or a substituted methine group; $R_5$ and $R_6$ each represents an alkyl group or a substituted alkyl group; $Z_1$ and $Z_2$ each represents an atomic group capable of forming a nitrogen-containing 5- or 6-membered heterocyclic nucleus; X represents an anion; n represents a whole number of 1, 3 or 5; $n_1$ and $n_2$ each is equal to 0 or 1 and when n=5−, both $n_1$ and $n_2$ are equal to 0, while when n=3, either $n_1$ or $n_2$ is equal to 0; m represents 0 or 1 but is equal to 0 when an inner salt is formed; when n is equal to 5, the L's may combine and form a substituted or unsubstituted 5- or 6-membered ring.

The cyanine dyes of general formula (I) are described in detail below.

Suitable substituents for the substituted methine group represented by L include lower alkyl groups (e.g., methyl, ethyl, etc.) and aralkyl groups (e.g. benzyl, phenethyl, etc.). The alkyl group represented by $R_5$ and $R_6$ may be straight-chain, branched or cyclic. The number of carbon atoms is important but preferably is between 1 and 8 and, for still better results, between 1 and 4. Suitable substituents for the substituted alkyl group include, inter alia, sulfonic acid, carboxy, hydroxy, alkoxy, acyloxy, and aryl (e.g., phenyl, substituted phenyl, etc.). These substituent groups may be present alone or two or more of them may be combinedly bound to the alkyl group. The sulfonic acid and carboxy groups may respectively form salts with alkali metal ions. The term 'combinedly' as used above is meant to include the case in which the two or more substituents are independently bound to the alkyl group as well as the case in which the substituents are combined and, then, attached to the alkyl group. Examples of the latter include sulfoalkoxyalkyl, sulfoalkoxyalkoxyalkyl, carboxyalkoxyalkyl and sulfophenylalkyl.

Examples of $R_5$ and $R_6$ are methyl, ethyl, n-propyl, n-butyl, vinylmethyl, 2-hydroxyethyl, 4-hydroxybutyl, 2-acetoxyethyl, 3-acetoxypropyl, 2-methoxyethyl, 4-methoxybutyl, 2-carboxyethyl, 3-carboxypropyl, 2-(2-carboxyethoxy)ethyl, 2-sulfoethyl, 3-sulfopropyl, 3-sulfobutyl, 4-sulfobutyl, 2-hydroxy-3-sulfopropyl, 2-(3-sulfopropoxy)ethyl 2-acetoxy-3-sulfopropyl, 3-methoxy-2-(3-sulfopropoxy)propyl, 2-[2-(3-sulfopropoxy)ethoxyethyl, 2-hydroxy-3-(3-sulfopropoxy)propyl and so on.

Examples of the nitrogen-containing heterocyclic nuclei as formed by $Z_1$ or $Z_2$ are an oxazole nucleus, a thiazole nucleus, a selenazole nucleus, an imidazole nucleus, a pyridine nucleus, an oxazoline nucleus, a thiazoline nucleus, a selenazoline nucleus, an imidazoline nucleus, etc. and fused ring structures formed by these nuclei respectively condensed to a benzene ring, naphthalene ring or another suitable saturated or unsaturated hydrocarbon ring. These nitrogen-containing heterocyclic rings may be substituted by various substituent groups such as alkyl, trifluoromethyl, alkoxycarbonyl, cyano, carboxy, carbamoyl, alkoxy, aryl, acyl, hydroxy and halogen. Anions represented by X include, inter alia, $Cl^-$, $Br^-$, $I^-$, $SO_4^{--}$, $NO_3^-$ and $ClO_4^{--}$.

The silver halide emulsion of the present invention cannot only be spectrally sensitized in the visible region but also in the infrared spectral sensitization. The spectral sensitizing dyes which can be advantageously utilized may be selected from among the compounds of the general formulas (II), (III) and (IV) shown hereinbelow.

The spectral sensitizing dyes are characterized in that they are adsorbed comparatively strongly on the surface of the silver halide grains and are difficultly desorbed even in the presence of couplers in the color photosensitive material.

In the present invention, spectral sensitization can be carried out to insure a spectral sensitivity peak at a wavelength of ≧720 nm by using at least one member selected from the class consisting of compounds of general formulas (II), (III) and (IV). In the color photosensitive material, at least one photosensitive layer can be spectrally sensitized so as to provide a spectral sensitivity peak at ≧720 nm by using a compound of general formula (II), (III) or (IV), however, it is preferable that two or more photosensitive layers be spectrally sensitized with dissimilar compounds selected from the compounds of general formulas (II), (III) and (IV).

While some of the compounds of general formulas (II), (III) and (IV) are adsorbed on silver halide emulsion grains to give spectral sensitivity peaks at ≧720 nm, others are only conductive to producing sensitivity peaks at <720 nm.

Therefore, if at least one photosensitive layer is spectrally sensitized to insure a spectral sensitivity peak at ≧720 nm, the other photosensitive layers may be respectively sensitized with one of the compounds of general formulas (II), (III) or (IV) or with a different compound such as a compound of general formula (I) to provide a spectral sensitivity peak at >720 nm The sensitizing dyes of general formula (II), (III) and (IV) are described in detail below.

General Formula (II)

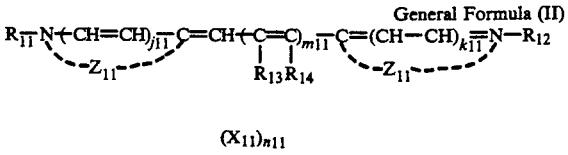

$(X_{11})_{n11}$ wherein $Z_{11}$ and $Z_{12}$ each represents an atomic group necessary to form a heterocyclic ring.

The heterocyclic ring mentioned above is preferably a 5- or 6-membered ring containing heteroatoms such as nitrogen, sulfur, oxygen, selenium and/or tellurium in addition to carbon, and may also be a fused cyclic structure formed by any of these heterocyclics condensed to another ring. Moreover, these rings may be substituted.

Examples of such heterocyclic nuclei include a thiazole nucleus, a benzothiazole nucleus, a naphthothiazole nucleus, a selenazole nucleus, a benzoselenazole nucleus, a naphthoselenazole nucleus, an oxazole nucleus, a benzoxazole nucleus, a naphthoxazole nucleus, an imidazole nucleus, a benzimidazole nucleus, a naphthoimidazole nucleus, a 2-quinoline nucleus, a 4-quinoline nucleus, a pyrroline nucleus, a pyridine nucleus, a tetrazole nucleus, an indolenine nucleus, a benzindolenine nucleus, an indole nucleus, a tellurazole nucleus, a benzotellurazole nucleus, a naphthotellurazole nucleus and so on.

$R_{11}$ and $R_{12}$ each represents an alkyl, alkenyl, alkynyl or aralkyl group. These groups and the groups described below may each be substituted. For example, the alkyl group includes both unsubstituted and substituted alkyl groups, and the alkyl moiety itself may be straight-chain, branched or cyclic. The preferred number of carbon atoms in the alkyl group is 1 to 8. Suitable substituents for the substituted alkyl group include, inter alia, halogen (chlorine, bromine, fluorine, etc.), cyano, alkoxy, substituted or unsubstituted amino, carboxy, sulfonic acid and hydroxy. These substituents may be present alone or in combination.

The alkenyl group may, for example, be vinylmethyl.

The aralkyl group may, for example, be benzyl or phenethyl.

The symbol $m_{11}$ means a whole number of 1, 2 or 3.

$R_{13}$ represents a hydrogen atom.

$R_{14}$ represents a hydrogen atom, a lower alkyl group or an aralkyl group, and may, taken together with $R_{12}$, form a 5- or 6-membered ring. When $R_{14}$ represents a hydrogen atom, $R_{13}$ may be bonded to another $R_{13}$ to form a hydrocarbon ring or a heterocyclic ring. Such a hydrocarbon ring or heterocyclic ring is preferably a 5-or 6-membered ring.

The symbol $j_{11}$ and $k_{11}$ each represents 0 or 1; $x_{11}$ represents an acid anion, and $n_{11}$ represents 0 or 1.

General Formula (III)

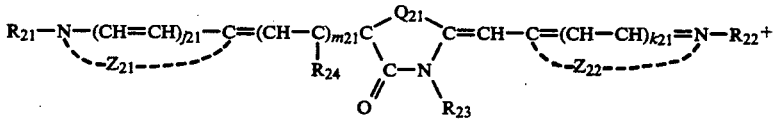

$(X_{21})_{n21}$

In the above formula, $Z_{21}$ and $Z_{22}$ each has the same meaning as $Z_{11}$ or $Z_{12}$: $R_{21}$ and $R_{22}$ each has the same meaning as $R_{11}$ or $R_{12}$: $R_{23}$ represents an alkyl group, an alkenyl group, an alkynyl group or an aryl group (e.g., substituted or unsubstituted phenyl); $m_{21}$ represents 1, 2 or 3; $R_{24}$ represents a hydrogen atom, a lower alkyl group or an aryl group, and may, taken together with another $R_{24}$, form a hydrocarbon ring or heterocyclic ring. This hydrocarbon ring or heterocyclic ring is preferably a 5- or 6-membered ring.

$Q_{21}$ represents a sulfur atom, an oxygen atom, a selenium atom or $>N-R_{25}$ where $R_{25}$ has the same meaning as $R_{23}$. The symbols $j_{21}$, $k_{21}$, $X_{21}$ and $n_{21}$ have the same meanings as; 11, $k_{11}$, $x_{11}$ and $n_{11}$, respectively.

General Formula (IV)

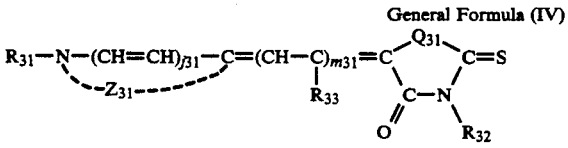

In the above formula, $Z_{31}$ means an atomic group necessary to form a heterocyclic ring. Examples of this heterocyclic ring include, in addition to the nuclei described above for $Z_{11}$ and $Z_{12}$, other rings such as a thiazolidine ring, a thiazoline ring, a benzothiazoliune ring, a naphthothiazoline ring, a selenazolidine ring, a selenazoline ring, a benzoselenaszoline ring, a naphthoselenazoline ring, a benzoxazoline ring, a naphthoxazoline ring, a dihydropyridine ring, a dihydroquinoline ring, a benzimidazoline ring, a naphthoimidazoline ring and so on.

$Q_{31}$ has the same meaning as $Q_{21}$. $R_{31}$ has the same meaning as $R_{11}$ or $R_{12}$, and $R_{32}$ has the same meaning as $R_{23}$. The symbol $m_{31}$ represents 2 or 3. $R_{33}$ has the same meaning as $R_{24}$, and may be bound to another $R_{33}$ to form a hydrocarbon ring or a heterocyclic ring. The symbol $j_{31}$ has the same meaning as $j_{11}$.

The sensitizing dyes of general formula (II) wherein $Z_{11}$ and/or $Z_{12}$ is a heterocyclic ring selected from the group consisting of naphthothiazole, naphthoselenazole, naphthoxazole, naphthoimidazole and 4-quinoline rings.

The same applies to $Z_{21}$ and $Z_{22}$ in general formula (III) and $Z_{31}$ in general formula (IV). Sensitizing dyes in which the methine chain forms a hydrocarbon ring or a heterocyclic ring are also useful.

For infrared sensitization, to utilize an M-band sensitizing dyes. Usually, therefore, the spectral sensitivity distribution is broader than it is with sensitization by the J-band. For this reason, it is preferable to control the spectral sensitivity distribution by disposing a colored layer containing a dye on the colloid layer located closer to the exposure side than the photosensitive layer. This dye layer is effective in preventing color mixing by a filter effect.

The red-sensitive or infrared-sensitive sensitizing dyes can be compounds with a negative reduction potential of −1.00 V (vs. SCE) or less and these are preferred as all particularly those having a negative reduction potential of −1.10 V or less are the mode desirable. Sensitizing dyes having this characteristics enhance the sensitivity stability and the latent image.

The reduction potential can be measured by phase-discriminating second harmonic alternating current polarography. A dropping mercury electrode is used as the active electrode, a saturated calomel electrode as the reference electrode, and a platinum electrode as the counter electrode.

The method for measurement of the reduction potential by phase-discriminating second harmonic Ac voltammetry is described in *Journal of Imaging Science* 30, 27–35, 1986.

It is also advantageous to employ in combination a compound selected from the group consisting of compounds of the general formulas (IV), (V), (VI) and (VII) described in Japanese Patent Application No. 63-310211, or a compound selected from among the formaldehyde condensates of compounds of general formulas (VIII-a), (VIII-b) and (VIII-c).

Examples of sensitizing dyes of general formulas (II), (III) and (IV) are given below.

(S-1)

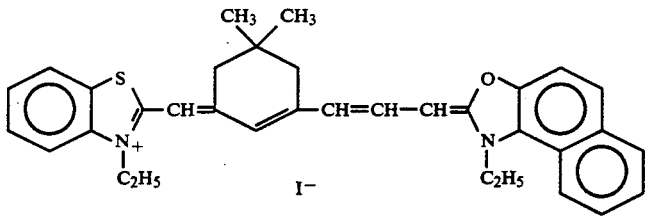

(S-2)

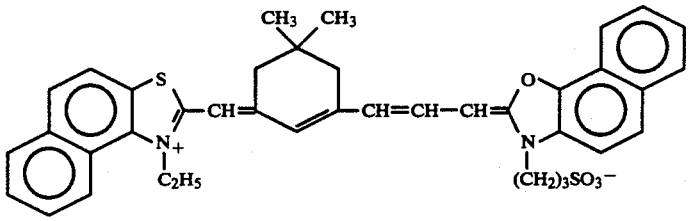

(S-3)

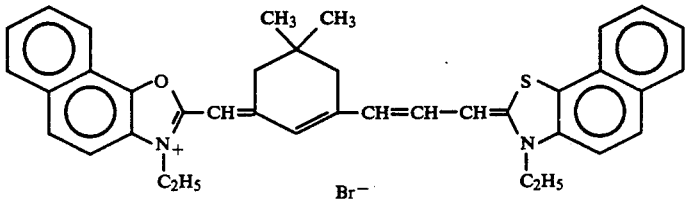

-continued
(S-4)
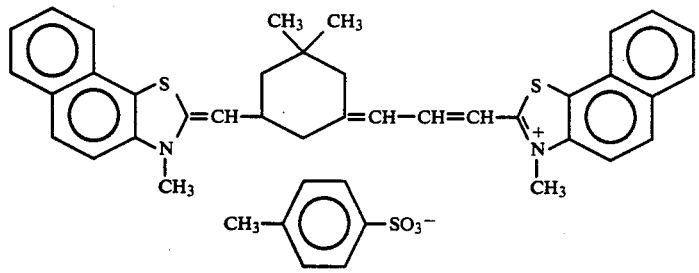
(S-5)
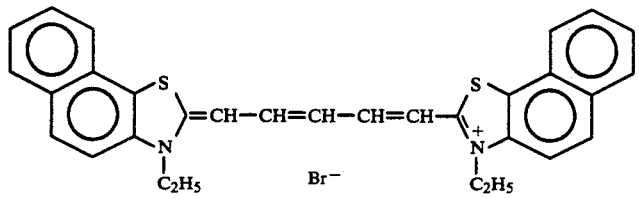
(S-6)
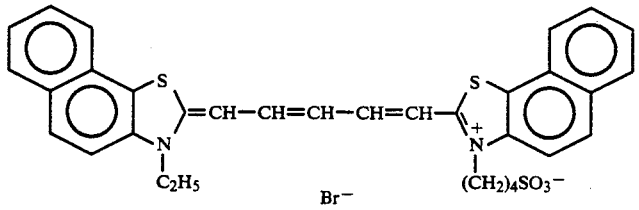
(S-7)
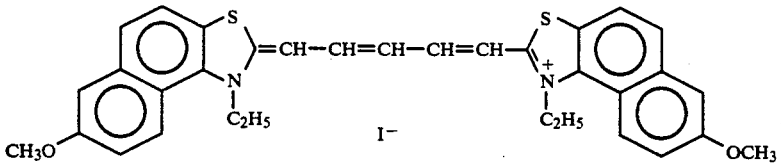
(S-8)
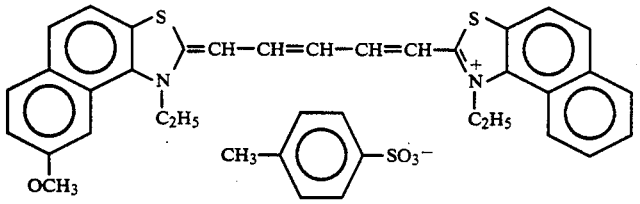
(S-9)
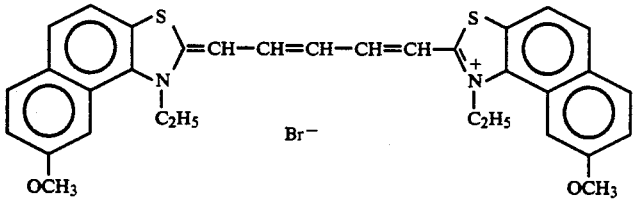
(S-10)
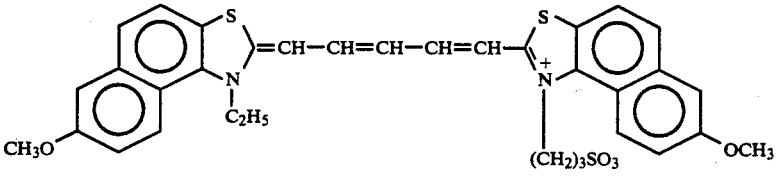

-continued
(S-11)
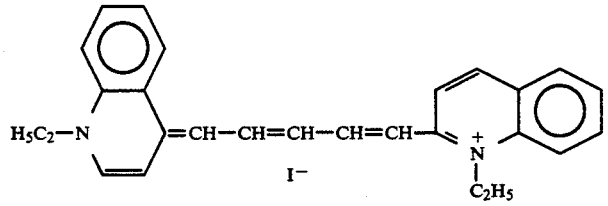
(S-12)
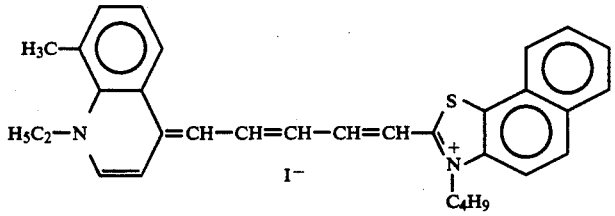
(S-13)
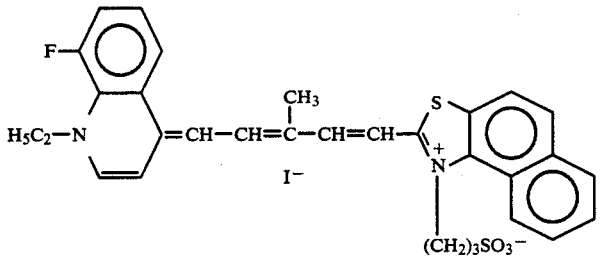
(S-14)
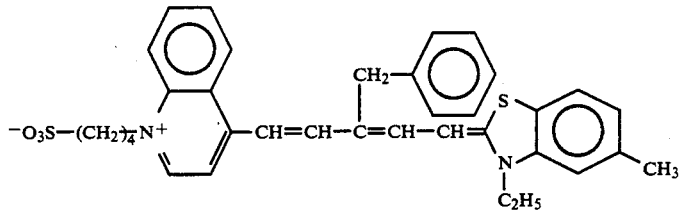
(S-15)
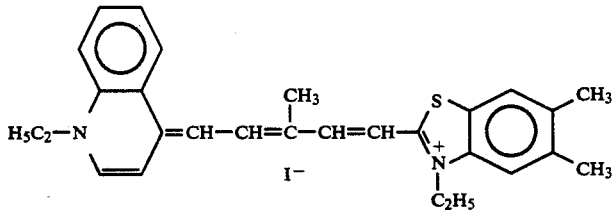
(S-16)
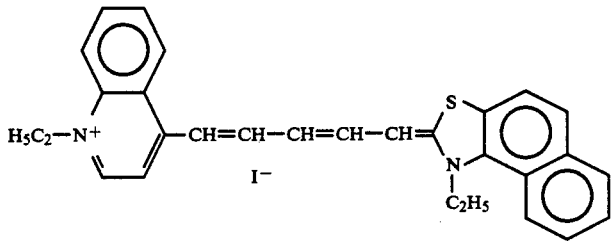

-continued
(S-17)
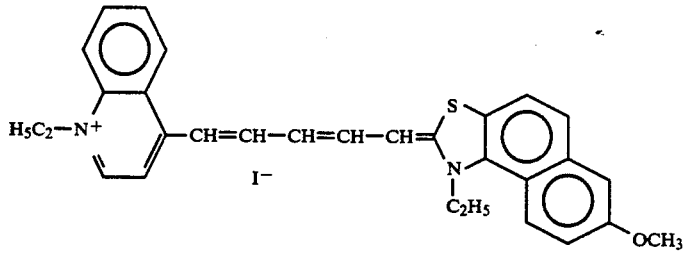
(S-18)
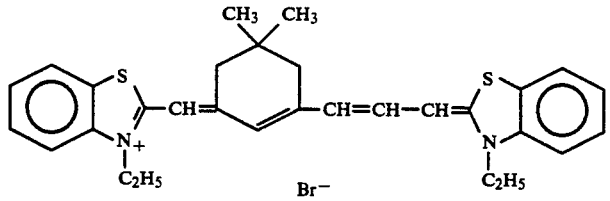
(S-19)
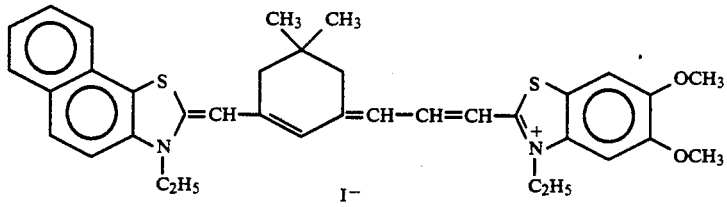
(S-20)
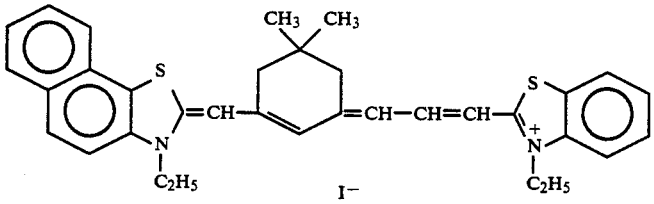
(S-21)
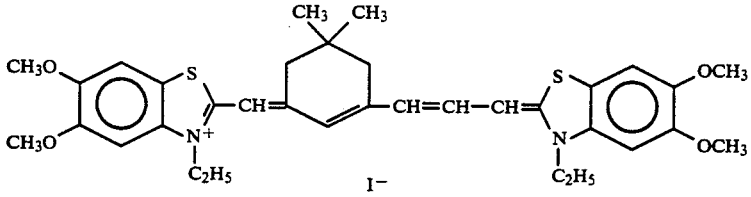
(S-22)
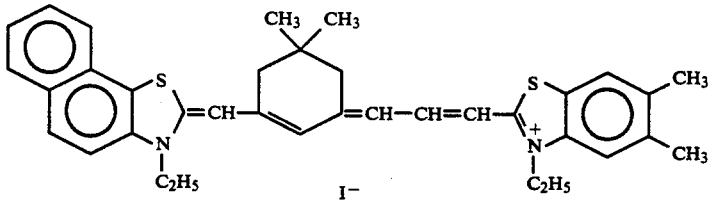
(S-23)
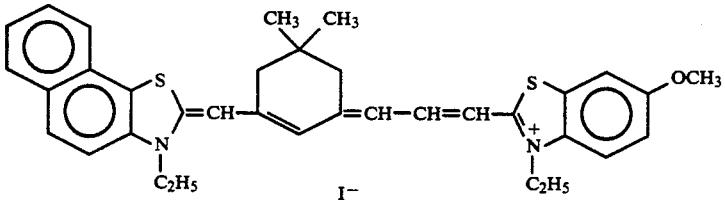

-continued
(S-24)
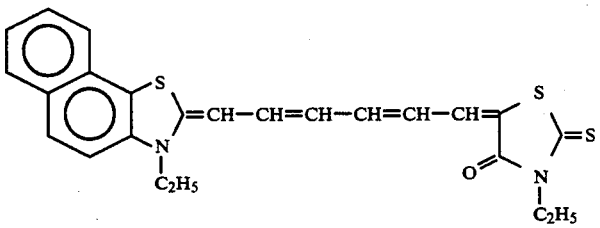
(S-25)
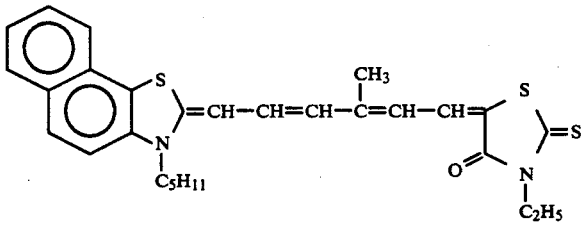
(S-26)
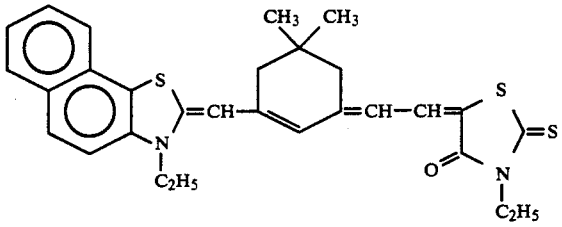
(S-27)
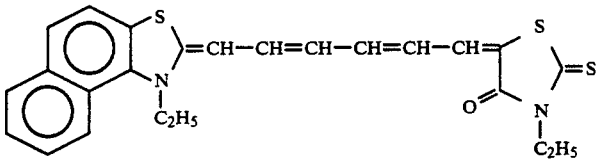
(S-28)
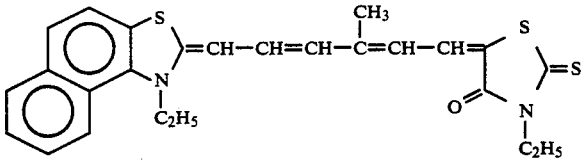
(S-29)
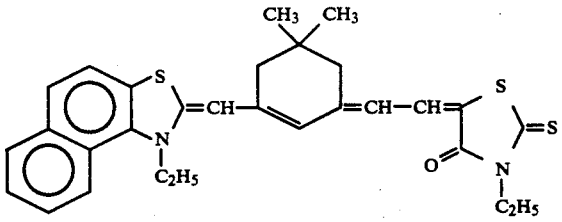
(S-30)
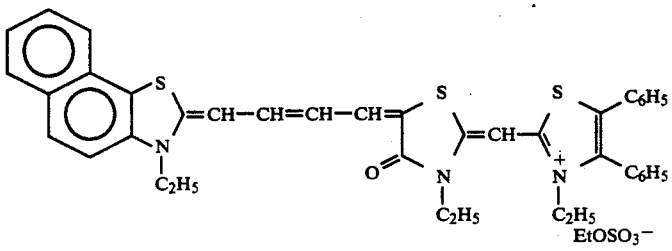

-continued
(S-31)
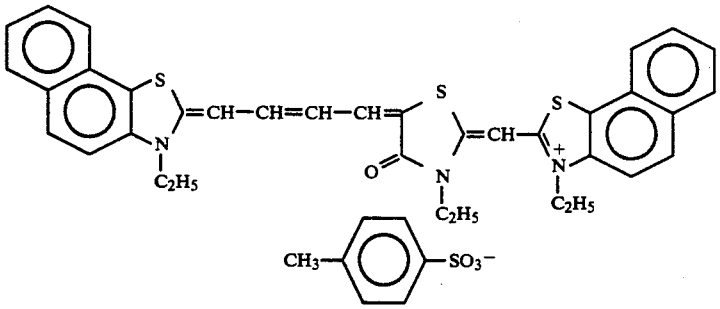
(S-32)
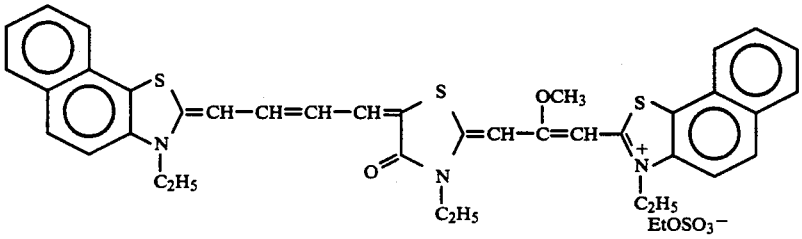
(S-33)
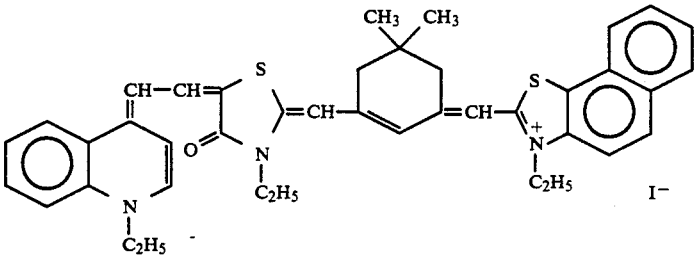
(S-34)
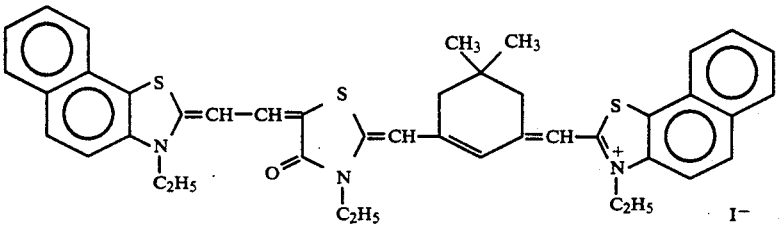
(S-35)
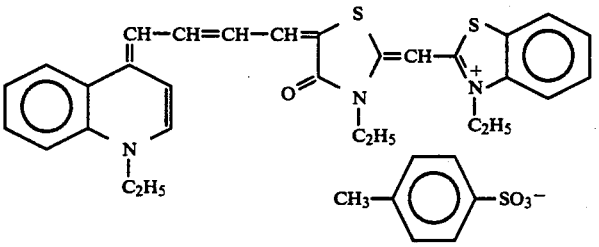
(S-36)
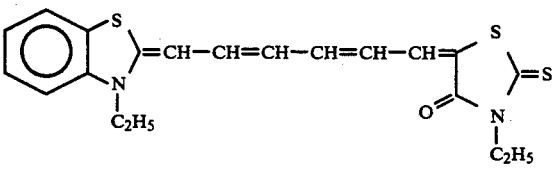

-continued
(S-37)
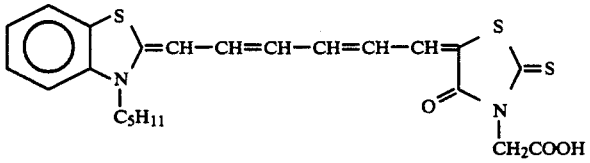
(S-38)
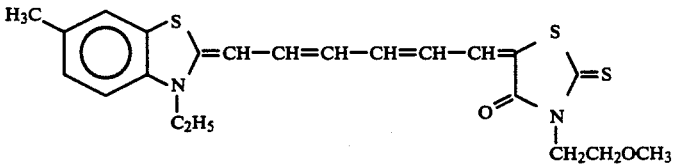
(S-39)
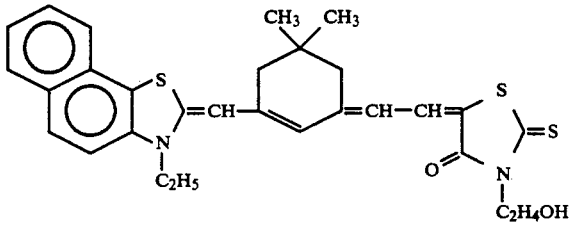
(S-40)
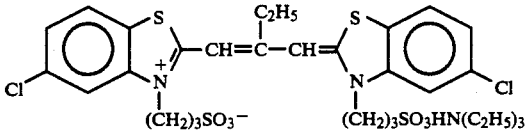
(S-41)
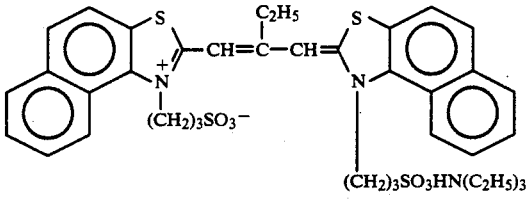
(S-42)
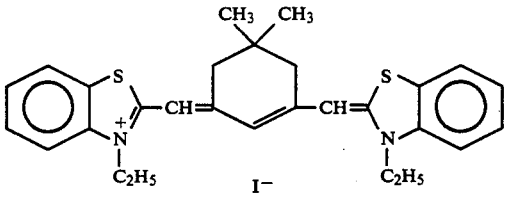
(S-43)
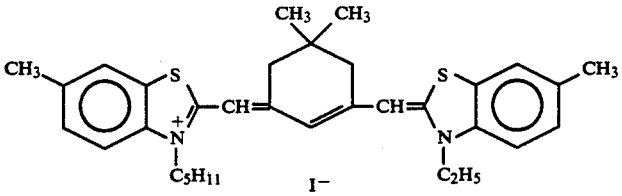
(S-44)
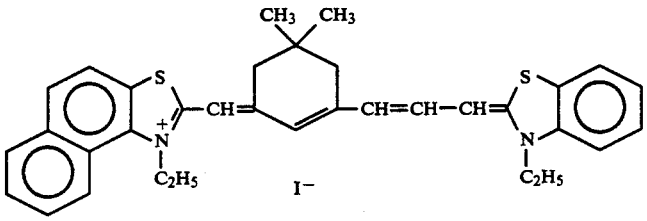

-continued
(S-45)
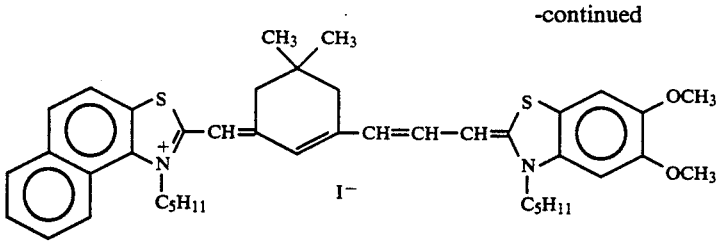
(S-46)
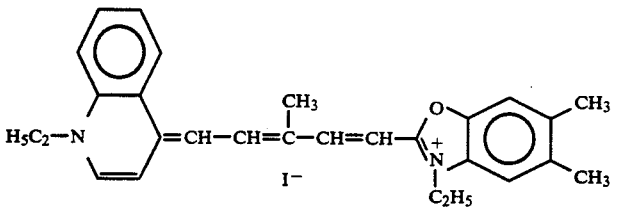
(S-47)
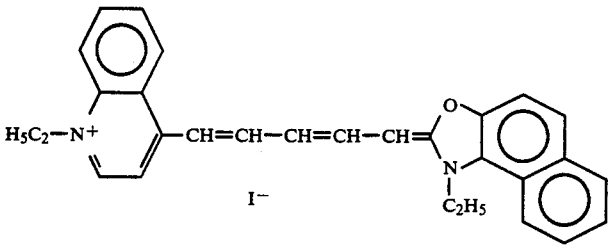
(s-48)
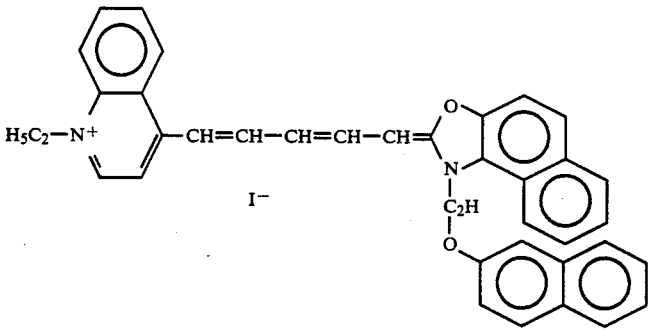
(S-49)
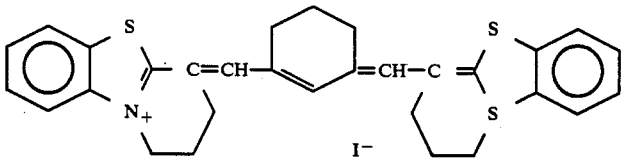
(S-50)
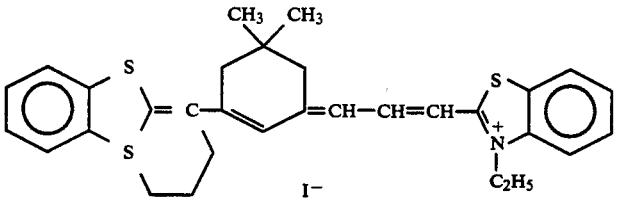
(S-51)
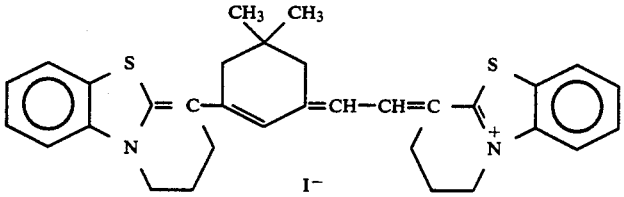

-continued
(S-52)
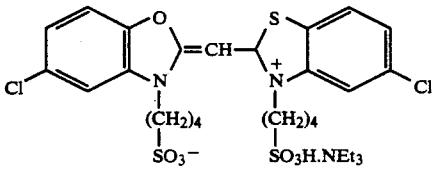
(S-53)
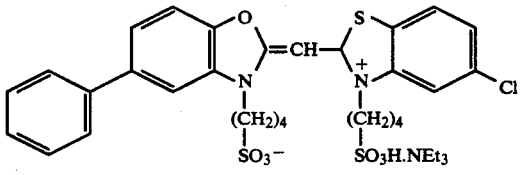
(S-54)
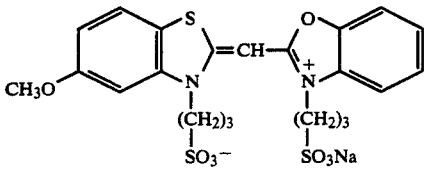
(S-55)
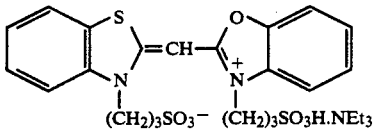
(S-56)
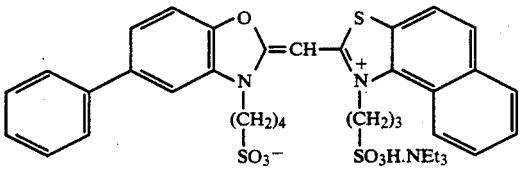
(S-57)
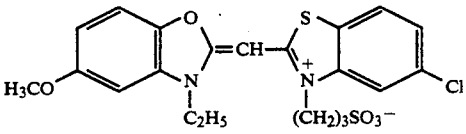
(S-58)
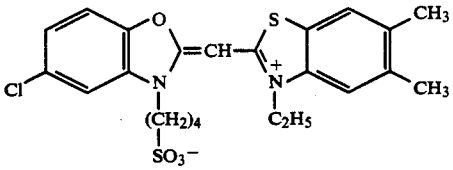
(S-59)
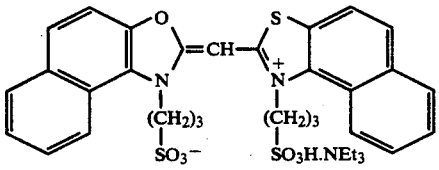
(S-60)
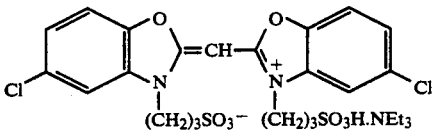

-continued
(S-61)
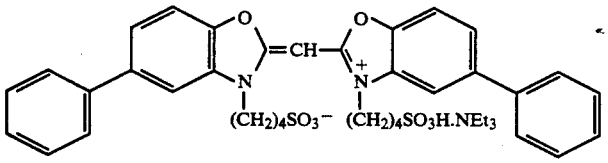
(S-62)
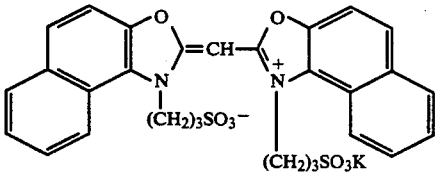
(S-63)
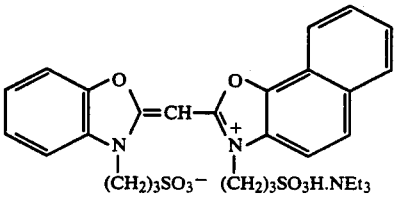
(S-64)
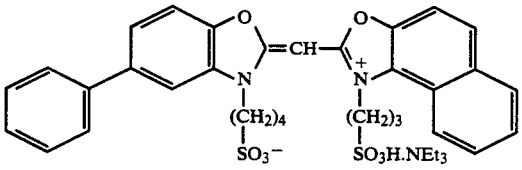
(S-65)
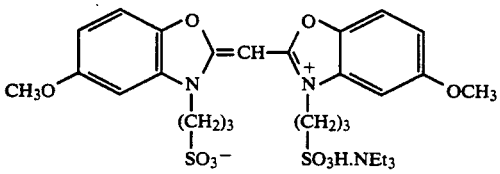
(S-66)
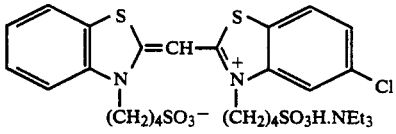
(S-67)
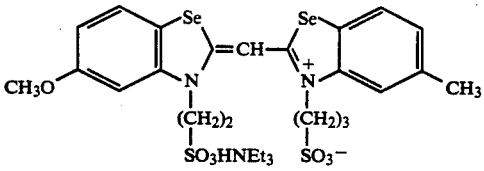
(S-68)
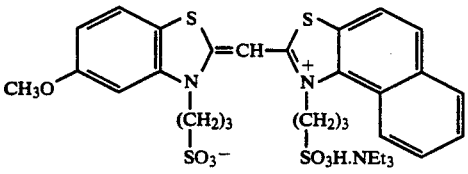
(S-69)
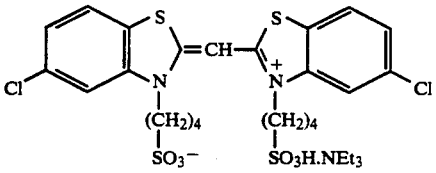

-continued
(S-70)
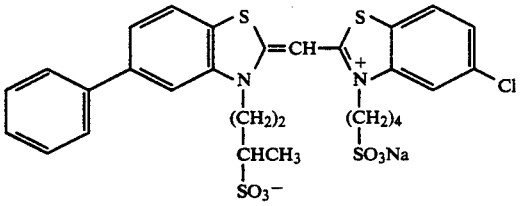
(S-71)
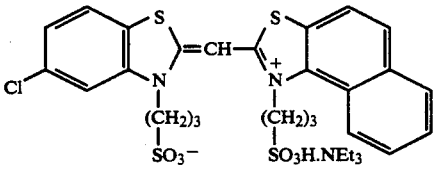
(S-72)
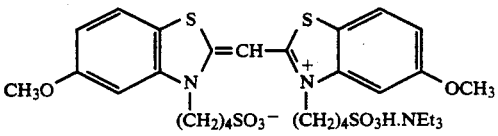
(S-73)
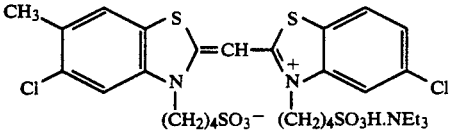
(S-74)
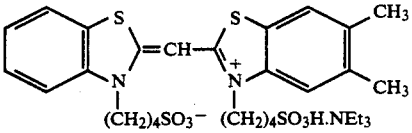
(S-75)
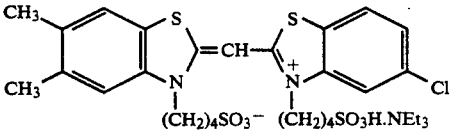
(S 76)
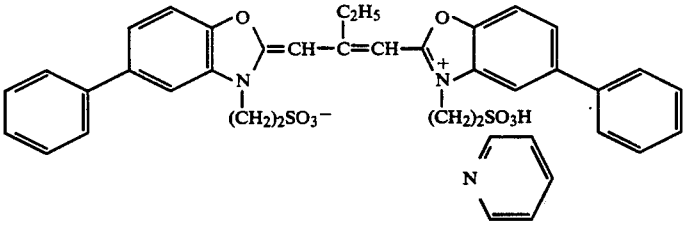
(S-77)
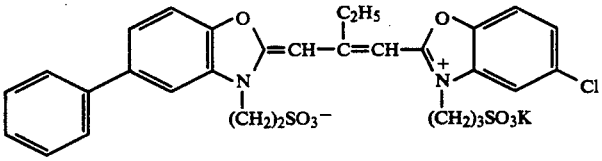
(S-78)
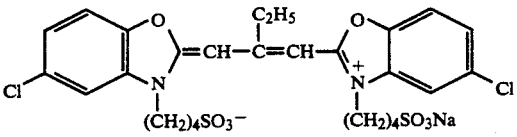

-continued
(S-79)
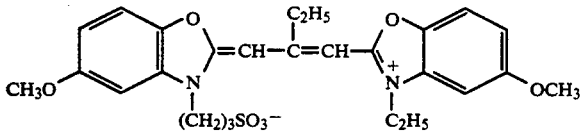
(S-80)
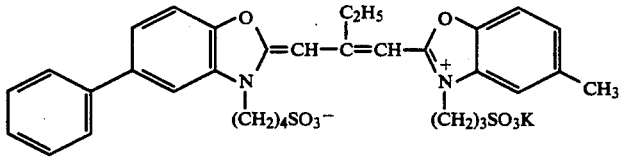
(S-81)
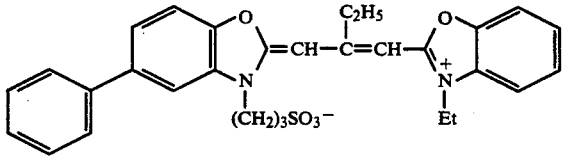
(S-82)
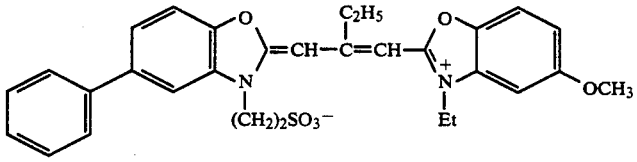
(S-83)
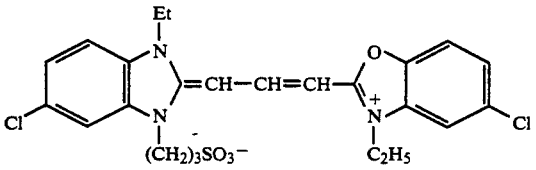
(S-84)
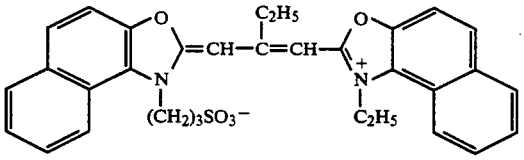
(S-85)
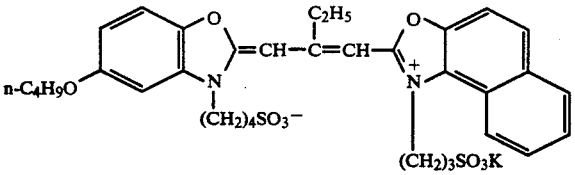
(S-86)
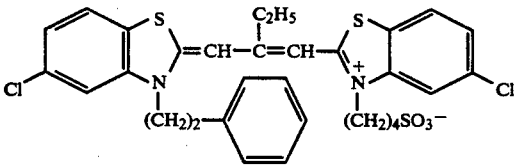
(S-87)
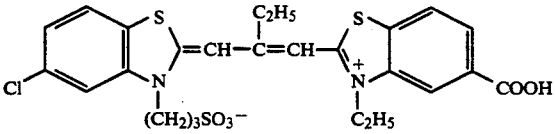

-continued
(S-88)
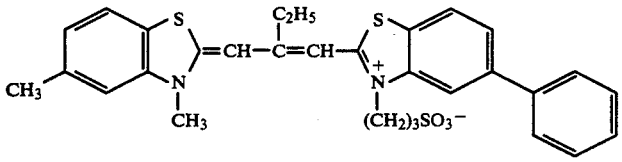
(S-89)
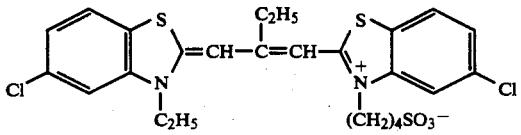
(S-90)
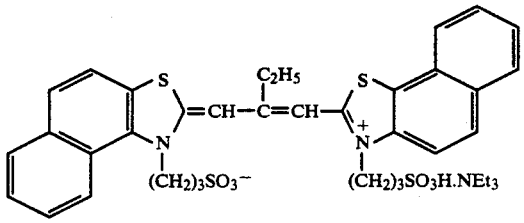
(S-91)
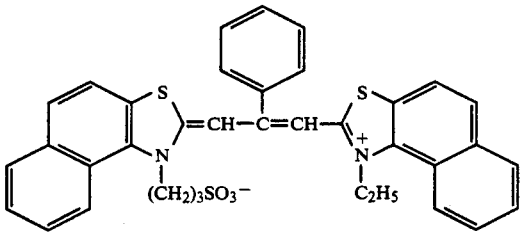
(S-92)
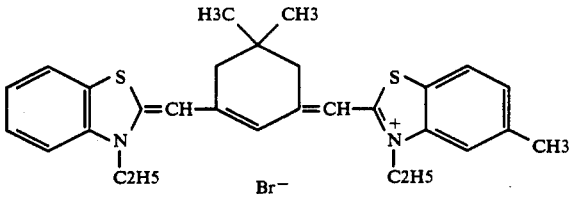
(S-93)
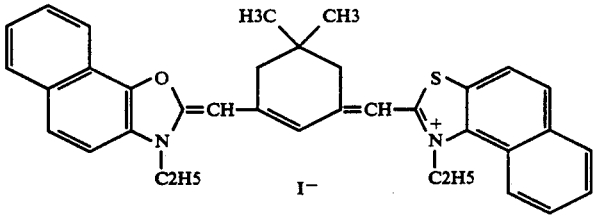
(S-94)
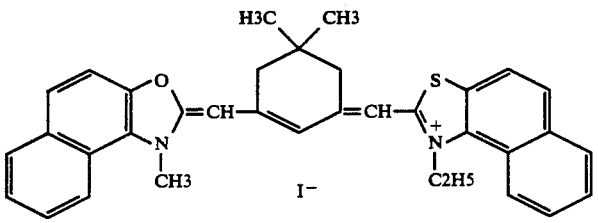

-continued (S-95)

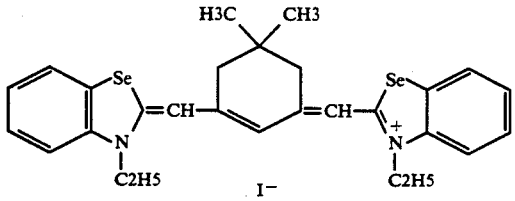

(S-96)

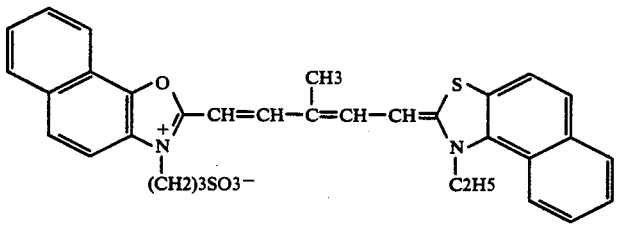

(S-97)

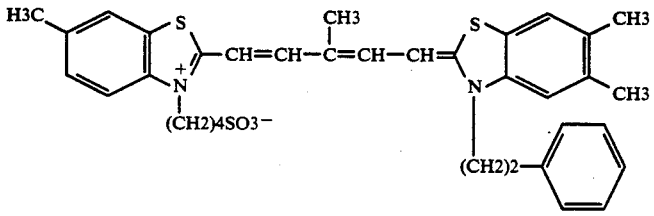

(S-98)

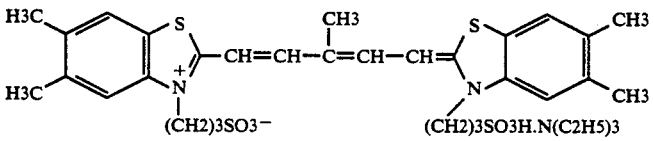

(S-99)

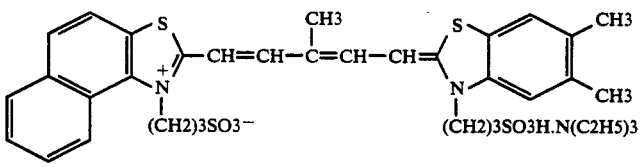

In the present invention, the sensitizing dye described hereinabove is incorporated in the silver halide photographic emulsion at a level, per mol of silver halide, of $5\times10^{-7}$ mol to $5\times10^{-3}$ mol, preferably $1\times10^{-6}$ mol to $1\times10^{-3}$ mol and, for still better results, $2\times10^{-6}$ mol to $5\times10^{-4}$ mol.

The sensitizing dye can be directly dispersed into the emulsion in the present invention. Alternatively, the dye may first be dissolved in an appropriate solvent such as methanol, ethanol, methylcellosolve, acetone, water or pyridine or a mixture thereof and, then, added to the emulsion. Ultrasonic waves can be utilized for dissolution. The infrared sensitizing dye can also be added by the method described in U.S. Pat. No. 3,469,987 which comprises dissolving the dye in a volatile organic solvent, dispersing the solution in a hydrophilic colloid and adding the dispersion to the emulsion, the method described in JP-B-46-24185 which comprises dispersing a water-insoluble dye in an aqueous solvent without prior dissolution and adding the dispersion to the emulsion, the method described in U.S. Pat. No. 3,822,135 which comprises dissolving the dye in a surfactant and adding the solution to the emulsion, the method described in JP-A-51-74624 which comprises using a red-shifting compound and adding the solution to the emulsion, or the method described in JP-A-50-80826 which comprises dissolving the dye in a substantially water-free acid and adding the solution to the emulsion. In addition to the above methods, the addition of the dye to the emulsion can also be accomplished by the methods described in U.S. Pat. Nos. 2,912,343, 3,342,605, 2,996,287 and 3,429,835. The above-mentioned infrared sensitizing dye may be evenly dispersed in the silver halide emulsion before the latter is coated on a suitable support. Moreover, it can be added before chemical sensitization or in the latter-half of the stage of formation of the silver halide grains.

To insure compatibility with rapid color development processing, a coupler with a high mol ratio of colored coupler to developed silver halide is preferably employed in the silver halide color photographic material of the present invention. By so doing, the necessary amount of photosensitive silver halide can be decreased. Particularly the use of 2-equivalent coupler is preferred. Moreover, the 1-equivalent coupler method wherein the quinoned-iimine form of the aromatic amine color developing agent is caused to couple with a colored coupler and the subsequent single electron oxidation color-forming process is performed with an oxidizing agent other than silver halide can also be concomitantly employed.

Generally, in the color photosensitive material, a colored coupler is used to give a maximum color density of not less than 3 as a transmission density and not less than 2 as a reflection density. In the image forming process utilizing a scanning exposure means, wherein color toning is performed at the same time as color correction with an image processor, an excellent color image can be achieved with a maximum color reflection density of about 1.2 or preferably about 1.6 to 2.0. This means that the consumption of both the colored coupler and the photosensitive silver halide can be decreased.

The amount of the yellow coupler, the magenta coupler and the cyan coupler in the color photosensitive material, particularly as a reflection color photosensitive material, of the present invention is 2.5 to $10\times10^{-4}$, 1.5 to $8\times10^{-4}$ and 1.5 to $7\times10^{-4}$ mol/m$^2$, respectively.

Couplers suitable for the color photosensitive material of the present invention are described in detail below.

The cyan coupler, the magenta coupler and the yellow coupler which can be advantageously employed in the present invention are represented by the following general formulas (C-I), (C-II), (M-I), (M-II) and (Y).

General Formula (C-I)

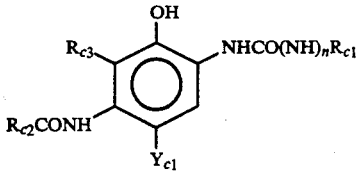

General Formula (C-II)

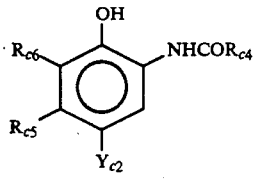

General Formula (M-I)

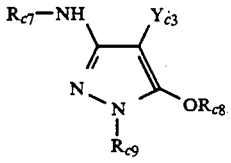

General Formula (M-II)

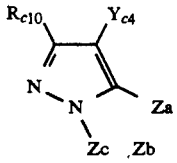

General Formula (Y)

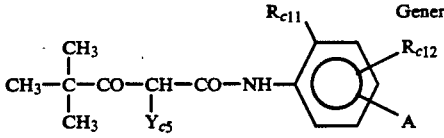

Referring to general formulas (C-I) and (C-II), $R_{C1}$, $R_{C2}$ and $R_{C4}$ each represents a substituted or unsubstituted aliphatic, aromatic or heterocyclic group; $R_{C3}$, $R_{C5}$ and $R_{C6}$ each represents a hydrogen atom, a halogen atom, an aliphatic group, an aromatic group or an acylamino group; $R_{C3}$ may represent a non-metal atomic group which, taken together with $R_{C2}$, forms a nitrogen-containing 5- or 6-membered ring; $Y_{C1}$ and $Y_{C2}$ each means a hydrogen atom or a group which may leave on coupling with oxidized developing agent; n means 0 or 1.

Referring to general formula (C-II), $R_{C5}$ is preferably an aliphatic group, such as methyl, ethyl, propyl, butyl, pentadecyl, tert-butyl, cyclohexyl, cyclohexylmethyl, phenylthiomethyl, dodecyloxyphenylthiomethyl, butaneamidomethyl, methoxymethyl and so on.

Preferred examples of cyan couplers of general formula (C-I) or (C-II) are as follows.

Referring to general formula (C-I), $R_{C1}$ is preferably an aryl group or a heterocyclic group and, for still better results, an aryl group substituted by halogen, alkyl, alkoxy, aryloxy, acylamino, acyl, carbamoyl, sulfonamido, sulfamoyl, sulfonyl, sulfamido, oxycarbonyl, and/or cyano.

Referring, further, to general formula (C-I), where $R_{C3}$ and $R_{C2}$ are not combined to form a ring, $R_{C2}$ is preferably a substituted or unsubstituted alkyl or aryl group and more desirably a substituted aryloxy-substituted alkyl group, while $R_{C3}$ is preferably a hydrogen atom.

Referring to general formula (C-II), $R_{C4}$ is preferably a substituted or unsubstituted alkyl or aryl group, and more desirably a substituted aryloxy-substituted alkyl group.

In general formula (C-II), $R_{C5}$ is preferably an alkyl group containing 2 to 15 carbon atoms or a methyl group having a substituent group containing 1 or more carbon atoms, with this substituent group being preferably arylthio, alkylthio, acylamino, aryloxy or alkyloxy.

More desirably, $R_{C5}$ in general formula (C-II) is an alkyl group having from 2 to 15 carbon atoms and most desirably it is an alkyl group having from 2 to 4 carbon atoms.

Referring, further to general formula (C-II), $R_{C6}$ is preferably a hydrogen atom or a halogen atom which is preferably chlorine or fluorine. Referring to general formulae (C-I) and (C-II), $Y_{c1}$ and $Y_{c2}$ each is preferably a hydrogen atom, a halogen atom, a an alkoxy group, an aryloxy group, an acyloxy group or a sulfonamido group.

Referring to general formula (M-I), $R_{c7}$ and $R_{c9}$ each represents an aryl group; $R_{c8}$ means a hydrogen atom, an aliphatic or aromatic acyl group, or aliphatic or aromatic sulfonyl group; $Y_{c3}$ is a hydrogen atom or a leaving group. The substituent groups which may be present on the aryl group (preferably, phenyl) for $R_{c7}$ and $R_{c9}$ are the same as those which may be present as substituent for $R_{c1}$, and when two or more substituent groups are present, they may be the same or different. $R_{c8}$ is preferably a hydrogen atom, an aliphatic acyl group or a sulfonyl group, and desirably a hydrogen atom. $Y_{c3}$ is preferably a group which leaves at a sulfur, oxygen or nitrogen atom and the sulfur atom-leaving groups disclosed in U.S. Pat. No. 4,351,897 and International. Laid-open Patent Application W088/04795 are particularly desirable.

Referring to general formula (M-II), $R_{c10}$ represents hydrogen atom or a substituent group. $Y_{c4}$ represents hydrogen atom or a leaving group, which is preferably a halogen atom or an arylthio group. Za, Zb and Zc each represents a methine group, a substituted methine group, =N— or —NH— and either one of the Za—Zb bond and the Zb—Zc bond is a double bond, with the other being a single bond. When the Zb—Zc bond is a carbon-carbon double bond, it may be part of an aromatic ring. The compound of the general formula (M-II) includes a dimer or higher polymer at $R_{c10}$ or $Y_{c4}$ or at Za, Zb, or Zc when Za, Zb or Zc is a substituted methine.

Of the pyrazoloazole couplers of general formula (M-II), the imidazo[1,2-b]pyrazoles disclosed in U.S. Pat. No. 4,500,630 and the pyrazolo[1,5-b][1,2,4]triazoles described in U.S. Pat. No. 4,540,654 are especially desirable from the standpoint of the low yellow side absorption of the colored coupler and in terms of light fastness.

Other desirable couplers include pyrazolotriazole couplers having a branched alkyl group directly attached to the 2-, 3- or 6-position of the pyrazolotriazole ring as described in JP-A-61-65245, pyrazoloazole couplers containing a sulfonamido group in the molecule as disclosed in JP-A-61-65246, pyrazoloazole couplers having an alkoxyphenylsulfonamide ballast group as described in JP-A-61-147254, and pyrazolotriazole couplers having an alkoxy or aryloxy group in the 6-position as described in European Laid-open Patent Nos. 226,849 and 294,785.

Referring to general formula (Y), $R_{c11}$ represents a halogen atoms, an alkoxy group, a trifluoromethyl group or an aryl group; $R_{12}$ represents a hydrogen atom, a halogen atom or an alkoxy group. The symbol A represents $—NHCOR_{c13}$, $—NHSO_2—R_{c13}$, $—SO_2NHR_{c13}$, $—COOR_{c13}$, $$—SO_2\underset{\underset{R_{c14}}{|}}{R_{c13}},$$

where $R_{c13}$ and $R_{c14}$ each represents an alkyl group, an aryl group or an acyl group. $Y_{c5}$ represents a leaving group. The substituent groups $R_{12}$, $R_{c13}$ and $R_{c14}$ may be the same as those described for $R_{c1}$, and the leaving group $Y_{c5}$ is preferably a group which leaves via an oxygen or nitrogen atom, with a nitrogen atom-leaving group being particularly useful.

Representative examples of couplers of general formulas (C-I), (C-II), (M-I), (M-II) and (Y) are shown below.

(C-1)

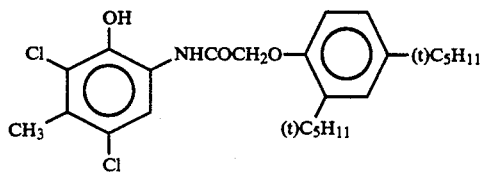

(C-2)

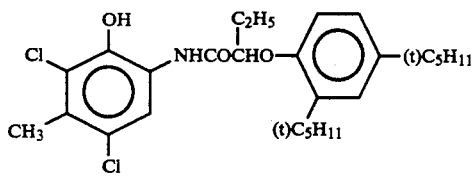

(C-3)

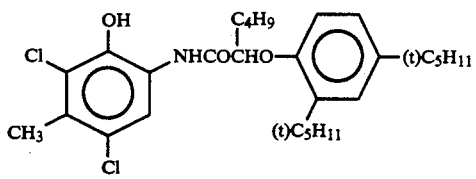

(C-4)

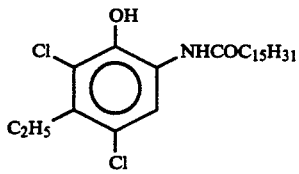

(C-5)

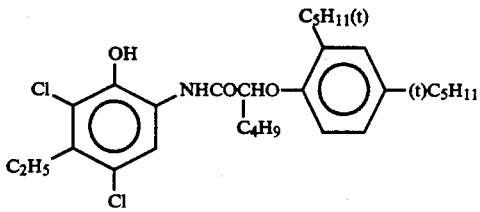

-continued
(C-6)
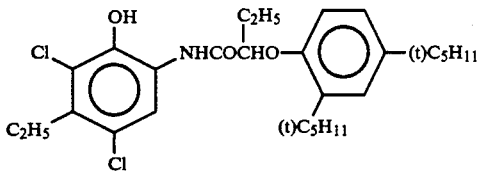
(C-7)
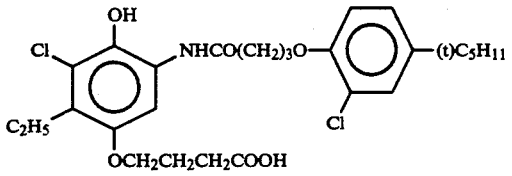
(C-8)
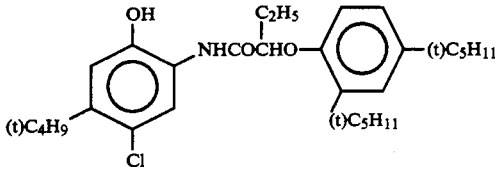
(C-9)
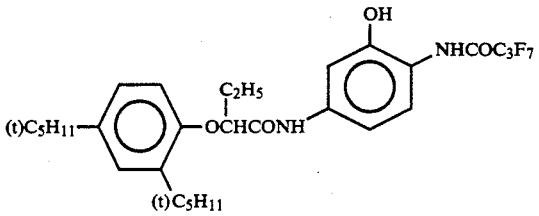
(C-10)
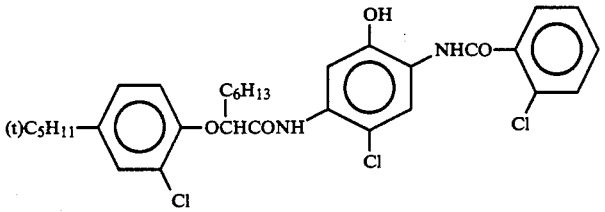
(C-11)
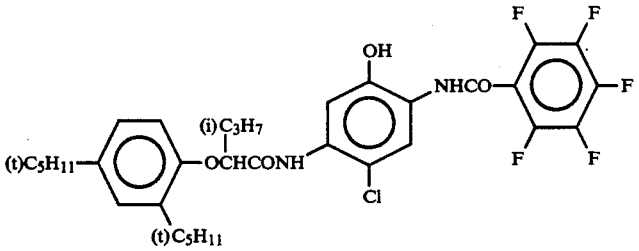
(C-12)
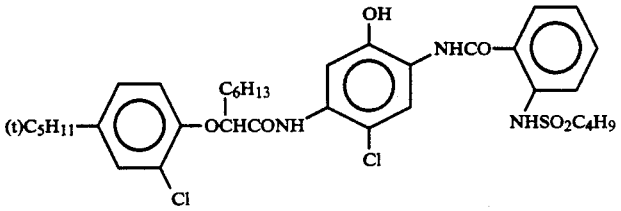

-continued
(C-13)
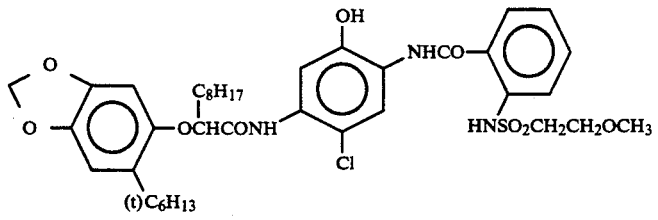
(C-14)
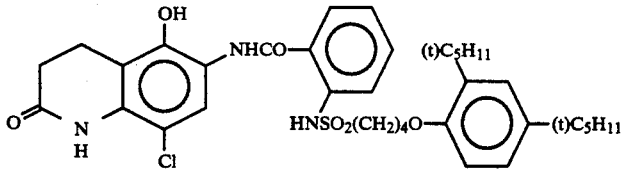
(C-15)
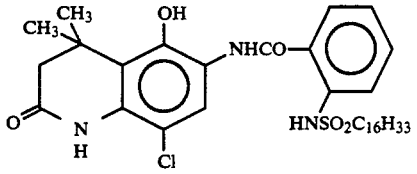
(C-16)
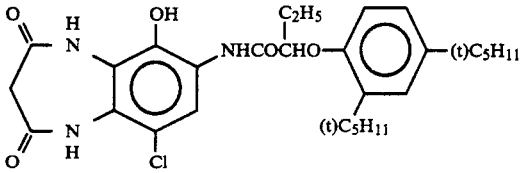
(C-17)
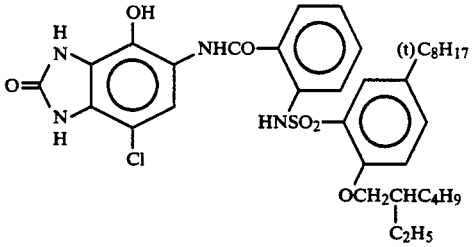
(C-18)
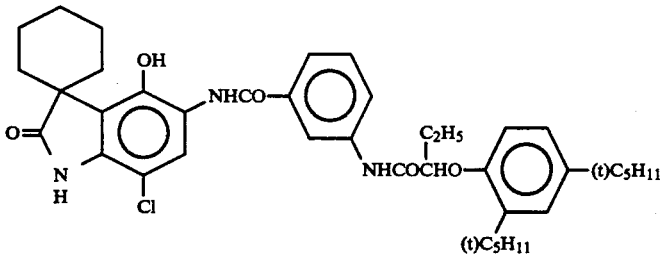
(C-19)
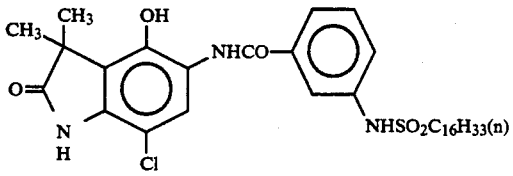

-continued
(C-20)
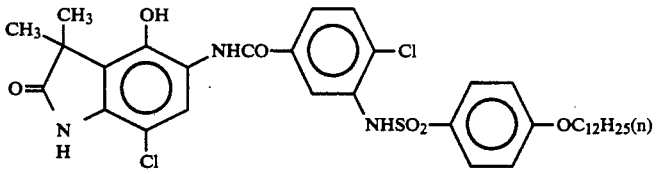
(C-21)
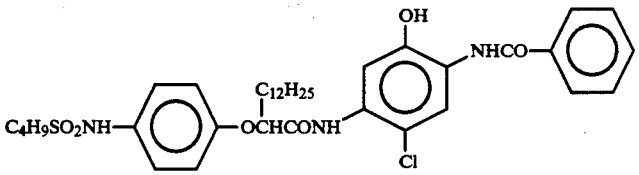
(C-22)
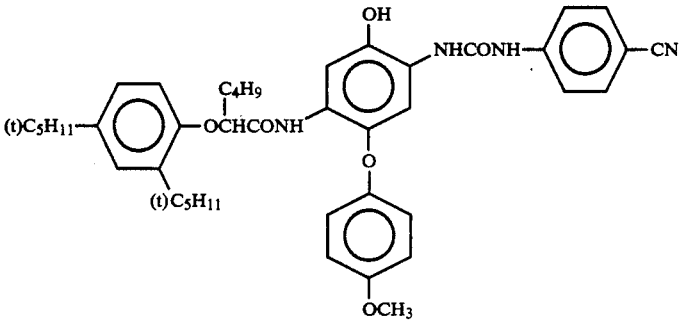
(M-1)
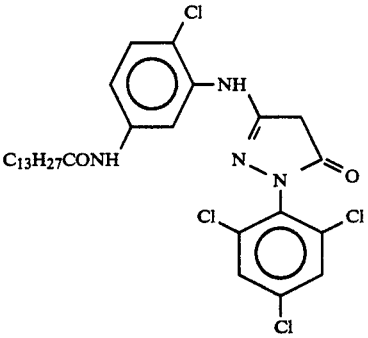
(M-2)
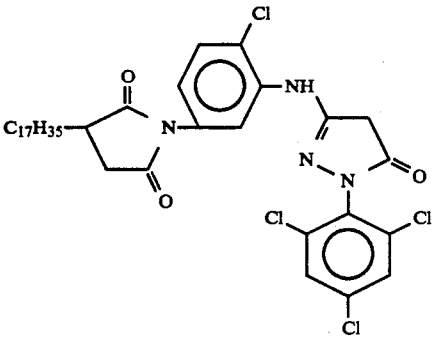

-continued
(M-3)
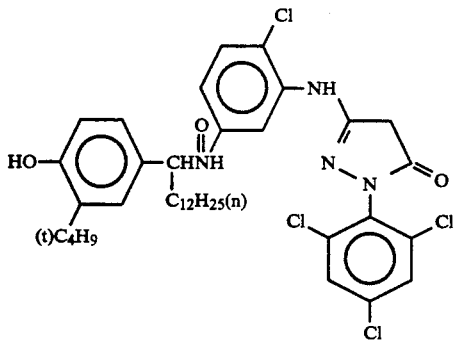
(M-4)
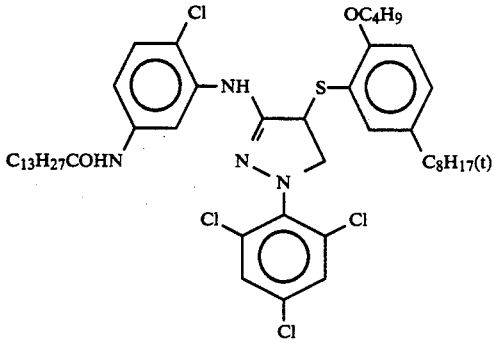
(M-5)
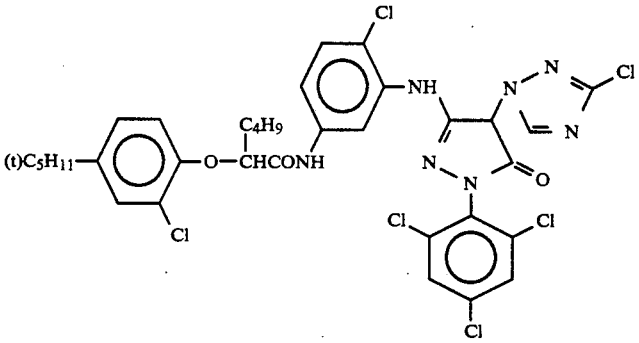
(M-6)
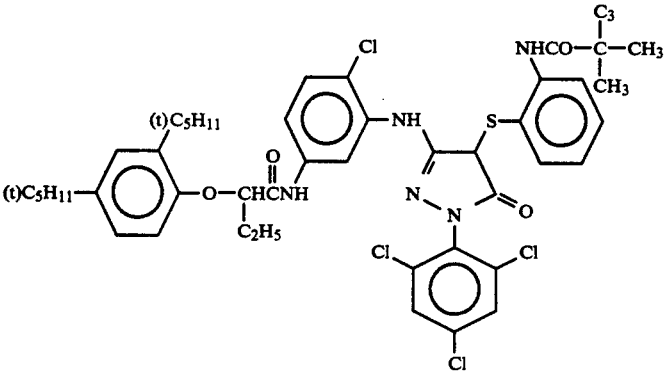

-continued
(M-7)
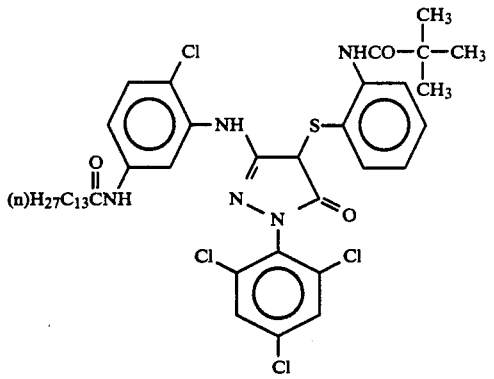
(M-8)
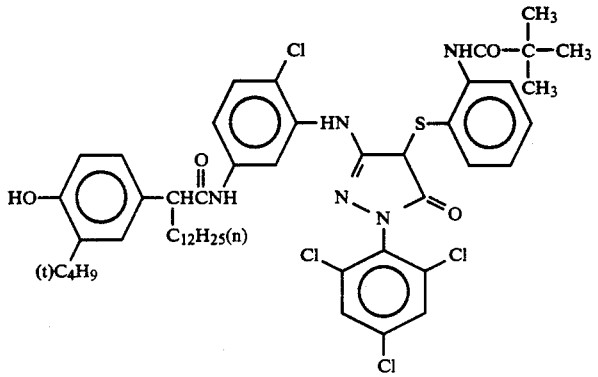

| Compound | $R_{c10}$ | $R_{c15}$ | $Y_{c4}$ |
|---|---|---|---|
| | | 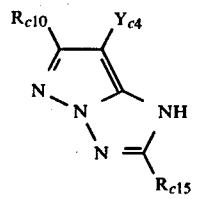 | |
| M-9 | $CH_3$— | 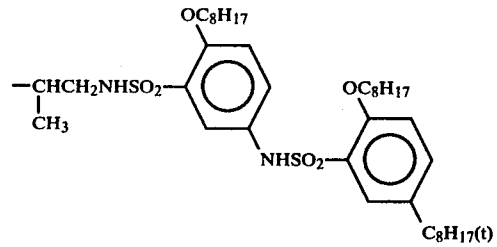 | Cl |
| M-10 | " | 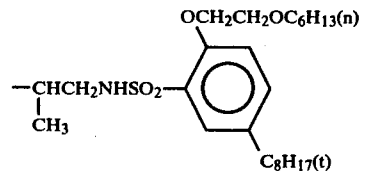 | " |
| M-11 | $(CH_3)_3C$— | 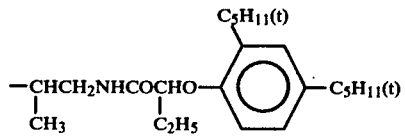 | 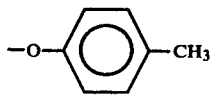 |
| M-12 | 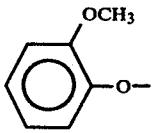 | 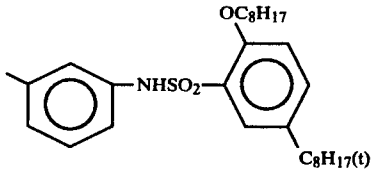 | 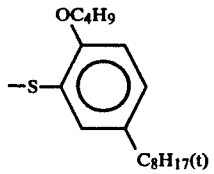 |

-continued
| Compound | $R_{c10}$ | $R_{c15}$ | $Y_{c4}$ |
|---|---|---|---|
| M-13 | $CH_3$— | 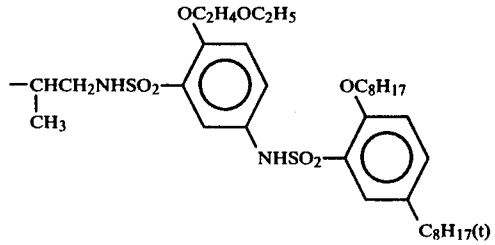 | Cl |
| M-14 | " | 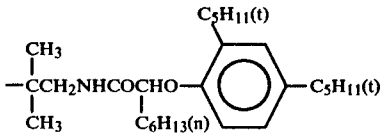 | " |
| M-15 | $CH_3$— | 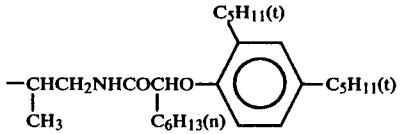 | Cl |
| M-16 | " | 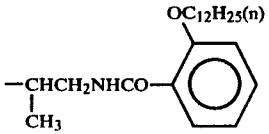 | " |
| M-17 | " | 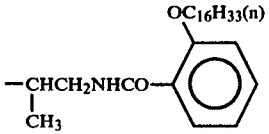 | " |

-continued
| Compound | $R_{c10}$ | $R_{c15}$ | $Y_{c4}$ |
|---|---|---|---|
| M-18 | 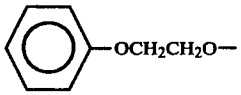 | 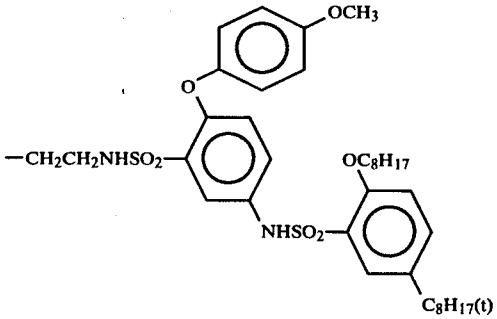 | 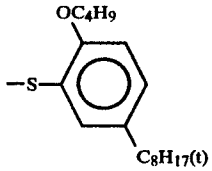 |
| M-19 | $CH_3CH_2O-$ | " | " |
| M-20 | 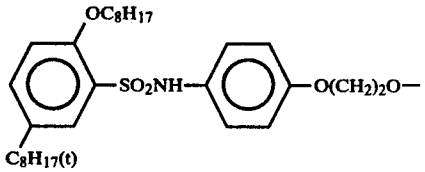 | 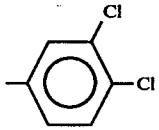 | 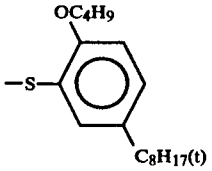 |
| M-21 | 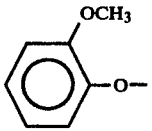 | 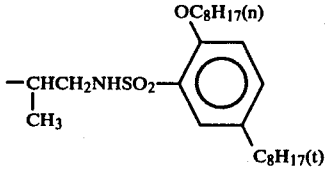 | Cl |
| | 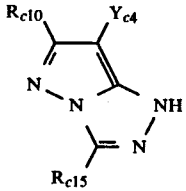 | | |
| M-22 | $CH_3-$ | 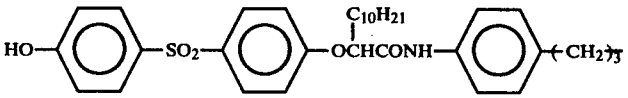 | Cl |

-continued

| Compound | $R_{c10}$ | $R_{c15}$ | $Y_{c4}$ |
|---|---|---|---|
| M-23 | " | $(n)C_6H_{13}$ \ $CHCH_2SO_2\text{-}(CH_2)_7\text{-}$ / $(n)C_8H_{17}$ | " |
| M-24 | $CH_3$ \ $CH-$ / $CH_3$ | $OC_4H_9$; $SO_2\text{-}(CH_2)_3$; $C_8H_{17}(t)$ | " |
| M-25 | $\text{-}(CH-CH_2)_{50}\text{-}(CH_2-C(CH_3))_{50}\text{-}$; $COOCH_2CH_2OCH_3$; $CONH-$ | $CH_3-CH-$; $CH_2NHSO_2CH_3$ | " |
| M-26 | $-O-$ | $OC_8H_{17}$; $\text{-}(CH_2)_2NHSO_2-$; $C_8H_{17}(t)$ | Cl |
| M-27 | $CH_3-$ | $CH_3$; $CH_3$; $CH_3$; $NHCOCHO-$; $(n)C_{10}H_{21}$; $SO_2$; $OCH_2$ | " |
| M-28 | $(CH_3)_3C-$ | $CH_3$; $CH_3$; $CH_3$; $C_5H_{11}(t)$; $NHCOCHO-$; $C_4H_9(n)$; $C_5H_{11}(t)$ | " |

-continued
| Compound | $R_{c10}$ | $R_{c15}$ | $Y_{c4}$ |
|---|---|---|---|
| M-29 | 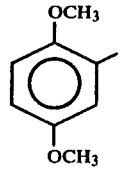 | 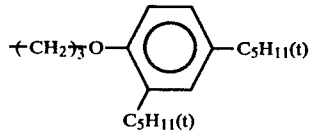 | Cl |
| M-30 | $CH_3$— | $-CH(C_2H_5)-N(C_{18}H_{37}(n))COCH_2CH_2COOH$ | " |

(Y-1)
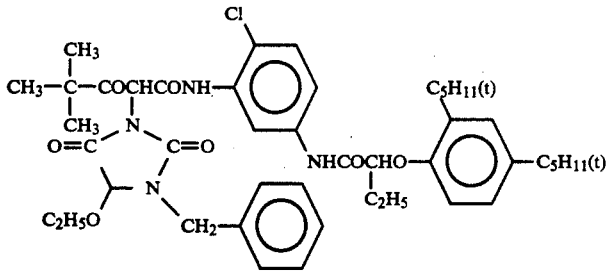
(Y-2)
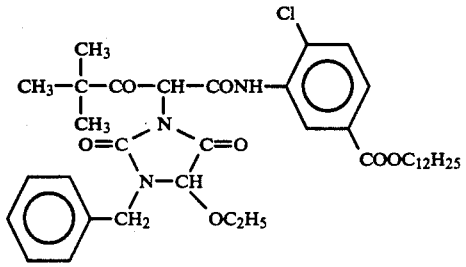
(Y-3)
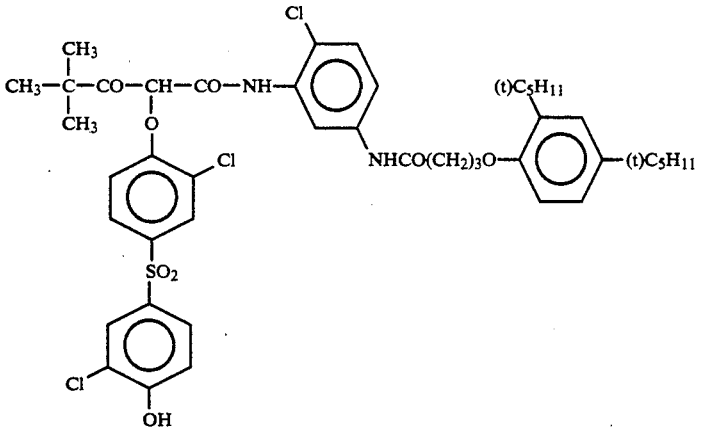
(Y-4)
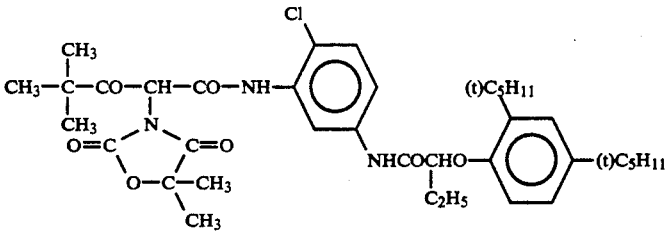
(Y-5)
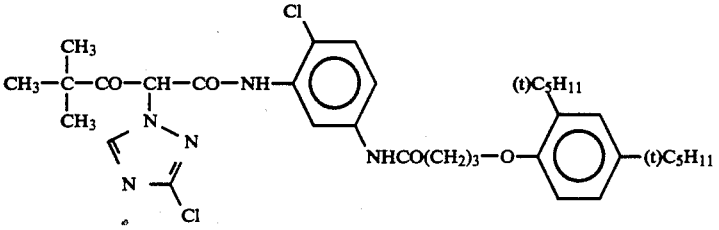

-continued (Y-6)

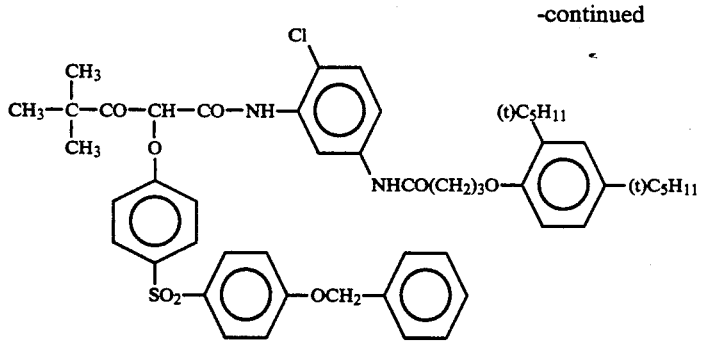

(Y-7)

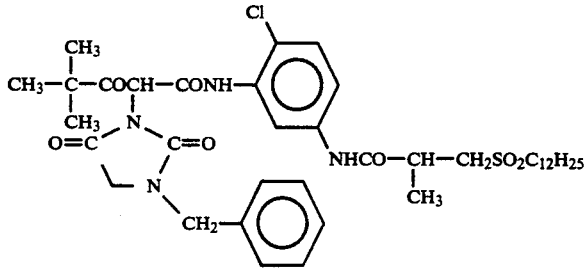

(Y-8)

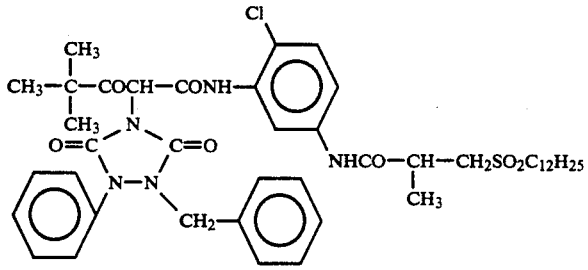

(Y-9)

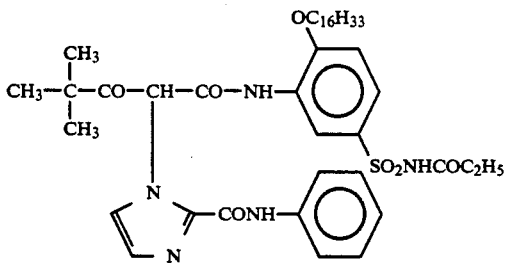

The coupler of general formulas (C-I) through (Y) is incorporated in the silver halide emulsion photosensitive layer in a proportion of generally 0.1 to 1.0 mol and preferably 0.1 to 0.5 mol per mol of silver halide.

In the present invention, the above coupler can be added to the photosensitive coupler using various known techniques. For example, the oil-in-water dispersion method, also known as the oil-protect method, can be employed for this purpose. The coupler is dissolved in a solvent and the solution is dispersed and emulsified in an aqueous solution of gelatin containing a surfactant. As an alternative, a surfactant-containing solution of the coupler is diluted with water or an aqueous solution of gelatin to produce an oil-in-water dispersion by the phase transfer process. Alkali-soluble couplers can be dispersed by Fischer dispersion method as well. The low-boiling organic solvent can be removed from the coupler dispersion before mixing with the photographic emulsion by distillation, noodle washing or ultrafiltration.

The preferred dispersion medium for couplers is a high-boiling organic solvent with a dielectric constant (25° C.) of 2 to 20 and a refractive index (25° C.) of 1.5 to 1.7 and/or a water-insoluble polymer compound.

The high-boiling organic solvent is preferably selected from solvents of the following general formulas (A) through (E).

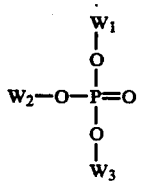

General Formula (A)

$W_1-COO-W_2$ General Formula (B)

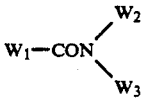

General Formula (C)

-continued

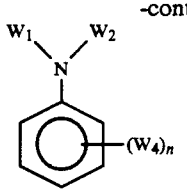

General Formula (D)

$W_1—O—W_2$ General Formula (E)

In the above formulas, $W_1$, $W_2$ and $W_3$ each represents a substituted or unsubstituted alkyl, cycloalkyl, alkenyl, aryl or heterocyclic group; $W_4$ represents $W_1$, $OW_1$ or $S—W_1$; n represents a whole number of 1 to 5; when n is not less than 2, the $W_4$'s may be the same or different. In general formula (E), $W_1$ and $W_2$ may combine and form a ring.

The high-boiling organic solvent which can be used in the practice of the invention is not limited to the solvents of general formulas (A) through (E) but may be any good solvent for couplers that is immiscible with water and has a melting point of not higher than 100° C. and a boiling point of not less than 140° C. The melting point of the high-boiling solvent is preferably not higher than 80° C. The boiling point of the high-boiling solvent is preferably not less than 160° C. and, for still better results, not less than 170° C.

Detailed information on these high-boiling organic solvents, is given in JP-A-62-215272 on page 137, right bottom column to page 144, right top column which disclosure is incorporated herein by reference.

The above-described couplers can be impregnated into a loadable latex polymer (e.g. as described in U.S. Pat. No. 4,203,716) in the presence or absence of a high-boiling organic solvent or dissolved in a polymer which is insoluble in water but soluble in an organic solvent and, then, dispersed and emulsified in an aqueous hydrophilic colloid solution.

The homopolymers and copolymers described in International Patent (Laid-Open) $W_{088/00723}$ on pages 12 to 30 can be advantageously employed and particularly the use of an acrylamide polymer is preferred for image stabilization.

The photosensitive material according to the present invention may contain a color antifoggant such as hydroquinone derivatives, aminophenol derivatives, gallic acid derivatives, ascorbic acid derivatives and so on.

A variety of antifading agents can be incorporated in the photosensitive material of the present invention. Organic fading inhibitors for cyan magenta and yellow images include hydroquinones, 6-hydroxychromans, 5-hydroxycoumarans, spirochromans, p-alkoxyphenols, bisphenols and other hindered phenols, gallic acid derivatives, methylenedioxybenzenes, aminophenolos, hindered amines, and various ether or ester compounds derived from the above-mentioned compounds by silylation or alkylation of the phenolic hydroxy groups. Furthermore, metal complexes represented by (bis salicylaldoximato)nickel complex and (bis-N,N-dialkyldithiocarbamato)nickel complex can also be employed.

With regard to specific examples of the organic color fading inhibitors, the relevant descriptions in the specifications of the following patents are incorporated herein by reference.

Hydroquinones: U.S. Pat. Nos. 2,360,290, 2,418,613, 2,700,453, 2,701,197, 2,728,659, 2,732,300, 2,735,765, 3,982,944 and 4,430,425, British Patent No. 1,363,921, U.S. Pat. Nos. 2,710,801 and 2,816,028, etc.;

6-Hydroxychromans, 5-hydroxycoumarans and spirochromans: U.S. Pat. Nos. 3,432,300, 3,573,050, 3,574,627, 3,698,909 and 3,764,337, JP-A-52-152225, etc.;

Spiroindans: U.S. Pat. No. 4,360,589;

p-Alkoxyphenols: U.S. Pat. No. 2,735,765, British Patent No. 2,066,975, JP-A-59-10539, JP-B-57-19765, etc.;

Hindered phenols: U.S. Pat. No. 3,700,455, JP-A-52-72224, U.S. Pat. No. 4,228,235, JP-B-52-6623, etc.;

Gallic acid derivatives: U.S. Pat. No. 3,457,079, etc.;

Methylenedioxybenzenes: U.S. Pat. No. 4,332,886, etc.;

Aminophenols: JP-B-56-21144;

Hindered amines: U.S. Pat. Nos. 3,336,135 and 4,268,593, British Patent Nos. 1,326,889, 1,354,313 and 1,410,846, JP-B-51-1420, JP-A-58-114036, JP-A-59-53846 and JP-A-59-78344, etc.;

Metal complex compounds: U.S. Pat. Nos. 4,050,938 and 4,241,155, British Patent No. 2,027,731(A) and so on.

These compounds produce the expected effect when generally 5 to 10 weight % of each is co-emulsified with the corresponding colored coupler and incorporated in the photosensitive layer. For the prevention of thermal degradation and particularly photodegradation of a cyan dye image, it is still more effective to incorporate an ultraviolet absorber in the cyan dye-forming layer and the adjacent layer on either side thereof.

Suitable ultraviolet absorbers are aryl-substituted benzotriazole compounds, such as those described in U.S. Pat. No. 3,533,794, 4-thiazolidone compounds such as those disclosed in U.S. Pat. Nos. 3,314,794 and 3,352,681, etc., benzophenone compounds such as those described in JP-A-51-2784, etc., cinnamic acid esters such as the compounds described in U.S. Pat. Nos. 3,705,805 and 3,707,395, butadiene compounds such as those described in U.S. Pat. No. 4,045,229, and benzoxazoles such as those described in U.S. Pat. Nos. 3,406,070, 3,677,762 and 4,271,307. Ultraviolet-absorbing couplers (such as α-naphthol cyan dye-forming couplers) and ultraviolet-absorbing polymers can also be employed. These ultraviolet absorbers may be mordanted in a definite layer, if desired.

Particularly preferred UV absorbers are aryl-substituted benzotriazole compounds.

Furthermore, the following compounds are preferably used in combination with the above-described couplers, particularly with pyrazoloazole couplers.

Thus, a compound (F) which is chemically reacts with the residual aromatic amine developing agent after color development agent to form a chemically inert and substantially colorless compound and/or a compound (G) which is chemically reacts with the oxidation product of the residual aromatic amine developing agent after color development to form a chemically inert and substantially colorless compound may be advantageously used either independently or in combination to prevent staining and other unwanted effects due to dye formation by reaction between the coupler and the residual color developing agent, or the oxidation product thereof, in the film during storage.

Preferred examples of the compound (F) are those compounds which show a second-order reaction rate constant $K_2$ (in trioctyl phosphate at 80° C.) of 1.0 l/mol sec to $1\times10^{-5}$ l/mol.sec with respect to p-anisidine.

The second-order reaction rate constant can be determined by the procedure disclosed in JP-A-63-158545.

With $k_z$ in excess of the above, the compound itself is unstable and tends to react with gelatin and water and is decomposed. Conversely, with a $k_z$ value smaller than the above range, the compound reacts only slowly with the residual aromatic amine developing agent, thus failing to prevent the adverse secondary effects of the residual aromatic amine developing agent.

Particularly preferred classes of the compound (F) can be represented by the following general formulas (FI) and (FII).

$$R_{F1}-(A)_n-X_F \qquad \text{General Formula (FI)}$$

$$R_{F2}-\underset{\underset{B}{|}}{C}=Y_F \qquad \text{General Formula (FII)}$$

In the above formulas, $R_{F1}$ and $R_{F2}$ each represents an aliphatic, aromatic or heterocyclic group; n is equal to 1 or 0; A represents a group capable of reacting with an aromatic amine developing agent to form a chemical bond; $X_F$ represents a leaving group which is removed upon reaction with an aromatic amine developing agent; B represents a hydrogen atom, an aliphatic group, an aromatic group, a heterocyclic group, an acyl group or a sulfonyl group; and $Y_F$ is a group which promotes the addition reaction of an aromatic amine developing agent to a compound of general formula (FII); where $R_{F1}$ and $X_F$ or $Y_F$ and $R_{F2}$ or B may combine and form a cyclic structure.

Typical modes of the above chemical bonding to the residual aromatic amine developing agent are substitution and addition.

With regard to specific examples of the compound (FI) or compound (FII), the compounds mentioned in JP-A-63-158545, JP-A-62-283338, EP-A-298321 and EP-A-277589 (the term "EP-A" as used herein means a published unexamined European patent application), among others, can be advantageously employed.

A particularly preferred class of compound (G) which is chemically bound to the oxidation product of the residual aromatic amine developing agent after color development to form a chemically inert and substantially colorless compound can be represented by the following general formula (GI).

$$R_G-Z_G \qquad \text{General Formula (GI)}$$

wherein $R_G$ represents an aliphatic, aromatic or heterocyclic group; $Z_G$ represents a nucleophilic group or a group which is decomposed in a photosensitive material to release a nucleophilic group. Preferred species of compound (GI) are such that $Z_G$ in formula (GI) represents a group having a Pearson's nucleophilicity $^nCH_{31}$ value (R. G. Pearson et al., *J. Am. Chem. Soc.* 90, 319, 1968) of not less than 5, or a group derived therefrom.

Preferred specific compounds of general formula (GI) are described in EP-A-255722, JP-A-62-143048 and JP-A-62-229145, Japanese Patent Application Nos. 63-136724 and 62-214681, and EP-A-298321 and EP-A-277589, which are incorporated herein by reference.

Detailed information can be found in EP-A-277589 regarding the combination of compounds (G) and (F).

The photosensitive material according to the present invention may contain an ultraviolet absorber in a hydrophilic colloid layer. For this purpose, aryl-substituted benzotriazole compounds (e.g. those described in U.S. Pat. No. 3,533,794), 4-thiazolidone compounds (e.g. those described in U.S. Pat. Nos. 3,314,794 and 3,352,681), benzophenone compounds (e.g. those described in JP-A-51-2784), cinnamic acid ester compounds (e.g. those described U.S. Pat. Nos. 3,705,805 and 3,707,375), butadiene compounds (e.g. those described in. U.S. Pat. No. 4,045,229) and benzoxidol compounds (e.g. those described in U.S. Pat. No. 3,700,455) can be advantageously employed. Ultraviolet-absorbing couplers (α-naphthol cyan dye-forming couplers) and ultraviolet-absorbing polymers can also be employed. These ultraviolet absorbers may be mordanted in a specific layer, if desired.

Gelatin can be advantageously used as the binder or protective colloid in the photosensitive layers of the photosensitive material according to the present invention. Moreover, other hydrophilic colloids can also be used independently or in combination with gelatin.

In the practice of the present invention, gelatin may be lime-processed gelatin or acid-processed gelatin. For detailed information on the technology of gelatin production, reference may be made to Arthur Vice: *The Macromolecular Chemistry of Gelatin,* Academic Press, 1964.

The color photosensitive material of the present invention may contain conventional photographic additives, particularly those which are commonly used in commercial color papers using high-silver chloride emulsions (a grain average silver chloride content ≧96 mol %) Additives and raw materials described in the following issues of *Research Disclosure* can be appropriately employed in the color photographic material of this invention.

| Type of Additives | RD 17643 | RD 18716 |
|---|---|---|
| 1. Chemical Sensitizers | Page 23 | Page 648, right column |
| 2. Sensitivity Enhancers | Page 23 | Page 648, right column |
| 3. Spectral Sensitizers | Pages 23 to 24 | Page 648, right column to page 649, right column |
| 4. Supersensitizers | Pages 23 to 24 | Page 648, right column to page 649, right column |
| 5. Whiteners | Page 24 | Page 648, right column to page 649, right column |
| 6. Antifoggants and Stabilizers | Pages 24 to 25 | Page 649, right column |
| 7. Couplers | Page 25 | Page 649, right column |
| 8. Organic Solvents | Page 25 | Page 649, right column |
| 9. Light Absorbers and Filter Dyes | Page 25 to 26 | Page 649, right column to page 650. left column |
| 10. UV Absorbers | Page 25 to 26 | Page 649, right column to page 650. left column |
| 11. Stain Inhibitors | Page 25, right column | Page 650, left column to right column |
| 12. Color Image Stabilizers | Page 25 | Page 650, left column to right column |
| 13. Film Hardeners | Page 26 | Page 651, left column |
| 14. Binders | Page 26 | Page 651, left column |
| 15. Platicizers and Lubricants | Page 27 | Page 650, right column |
| 16. Coating Aids and Surfactants | Pages 26 to 27 | Page 650, right column |

-continued

| Type of Additives | RD 17643 | RD 18716 |
|---|---|---|
| 17. Antistatic Agents | Page 27 | Page 650, right column |

The following examples are given to illustrate the present invention in greater detail but the present invention is not to be construed as being limited thereto. Unless otherwise indicated herein, all parts, percents, ratios and the like are by weight.

EXAMPLE 1

A silver halide color photographic material was prepared in accordance with Table 1 below. This sample was designated as Sample A.

TABLE 1

| Layer | Coating Composition | Coverage ($g/m^2$) |
|---|---|---|
| Seventh Layer (protective layer) | Gelatin | 1.00 |
| | Acryl-modified PVA (17% modification) | 0.12 |
| | Liquid paraffin | 0.05 |
| Sixth Layer (UV absorbing layer) | Gelatin | 0.65 |
| | Ultraviolet absorber (X-1) | 0.02 |
| | Ultraviolet absorber (X-2) | 0.09 |
| | Ultraviolet absorber (X-3) | 0.10 |
| | Color mixing inhibitor (H-1) | 0.02 |
| | Solvent (Sol-5) | 0.11 |
| Fifth Layer (cyan coupler layer) | Emulsion Al (as Ag) | 0.21 |
| | Gelatin | 1.10 |
| | Polymer (P-1) | 0.45 |
| | Cyan coupler (C-2) | 0.08 |
| | Cyan coupler (C-5) | 0.14 |
| | Cyan coupler (C-4) | 0.10 |
| | Cyan coupler (C-3) | 0.08 |
| | Color image stabilizer (X-1) | 0.04 |
| | Color image stabilizer (X-2) | 0.06 |
| | Color image stabilizer (X-4) | 0.06 |
| | Color image stabilizer (A-1) | 0.01 |
| | Color image stabilizer (B-1) | 0.01 |
| | Color image stabilizer (H-4) | 0.01 |
| | Color image stabilizer (H-2) | 0.04 |
| | Solvent (Sol-6) | 0.12 |
| | Solvent (Sol-7) | 0.12 |
| Fourth Layer (UV absorbing | Gelatin | 1.12 |
| | Ultraviolet absorber (X-1) | 0.04 |
| | Ultraviolet absorber (X-2) | 0.19 |
| | Ultraviolet absorber (X-3) | 0.20 |
| | Color mixing inhibitor (H-1) | 0.04 |
| | Solvent (Sol-5) | 0.18 |
| Third Layer (magenta coupler layer) | Emulsion A2 (as Ag) | 0.13 |
| | Gelatin | 2.36 |
| | Magenta coupler (M-13) | 0.19 |
| | Magenta coupler (M-15) | 0.07 |
| | Color image stabilizer (E-1) | 0.09 |
| | Color image stabilizer (A-1) | 0.07 |
| | Color image stabilizer (B-1) | 0.03 |
| | Color image stabilizer (H-3) | 0.01 |
| | Color image stabilizer (H-6) | 0.02 |
| | Solvent (Sol-1) | 0.37 |
| | Solvent (Sol-3) | 0.19 |
| Second Layer (color mixing inhibition layer) | Gelatin | 1.30 |
| | Color mixing inhibitor (H-1) | 0.12 |
| | Solvent (Sol-3) | 0.24 |
| | Solvent (Sol-4) | 0.24 |
| First Layer (yellow coupler layer) | Emulsion A3 (as Ag) | 0.30 |
| | Gelatin | 1.44 |
| | Polymer (P-1) | 0.18 |
| | Yellow coupler (Y-4) | 0.16 |
| | Yellow coupler (Y-6) | 0.20 |
| | Yellow coupler (Y-1) | 0.39 |
| | Color image stabilizer (H-4) | 0.01 |
| | Solvent (Sol-2) | 0.17 |
| | Solvent (Sol-6) | 0.16 |
| Support | $TiO_2$ 5 $g/m_2$(15 wt %)-containing polyethylene laminate sheet | |

Silver halide emulsions for the respective layers were prepared as follows.

Emulsion A1 for the Cyan Coupler-Containing Layer

In 1,000 ml of distilled water was dissolved 30 g of lime-processed gelatin at 40° C. and the solution was adjusted to pH 3.8 with sulfuric acid. Then, 0.02 g of N,N'-dimethylimidazolidine-2-thione and 5.0 g of sodium chloride were added and the temperature was increased to 52.5° C. Then, a solution of 62.5 g of silver nitrate in 750 ml of distilled water and a solution of 21.5 g of sodium chloride in 500 ml of distilled water were added to the above solution at a controlled temperature of 52.5° C. over a period of 40 minutes. Thereafter, a solution of 62.5 g of silver nitrate in 500 ml of distilled water and a solution of 21.5 g of sodium chloride in 300 ml of distilled water were further added at 52.5° C. over a 20 minute period with stirring. In this addition and mixing stage, $1\times10^{-8}$ mol/mol Ag of dipotassium iridium hexachloride and $1.5\times10^{-5}$ mol/mol Ag of potassium hexacyanoiron(II), both based on total silver halide, were added.

Electron microscopy of the resulting emulsion revealed cubic grains with an average edge length of about 0.46 μ and a coefficient of variation in grain size distribution of 0.13.

After the above emulsion was desalted and rinsed, 0.2 g of nucleic acid and 1.0 mol % silver halide equivalent of a monodisperse silver bromide emulsion with an average particle size of 0.05 (containing $1.2\times10^{-4}$ mol/mol Ag of dipotassium iridium hexachloride added. Then, the emulsion was chemically sensitized with about $2\times10^{-6}$ mol/mol Ag of triethylthiourea, followed by addition of $5\times10^{-6}$ mol/mol Ag of Compound (S-23), $1.1\times10^{-3}$ mol/mol Ag of Compound (I-1) and $1.8\times10^{-3}$ mol/mol Ag of Compound (F-1) to produce a final emulsion. Projecting silver bromide local phases were observed at the corners of the cubic grains in this emulsion.

Emulsion A2 for the Magenta Coupler-Containing Layer

To a base emulsion prepared in the same manner as described above for the preparation of the cyan coupler layer emulsion A1 was added $1.1\times10^{-5}$ mol/mol Ag of Compound (S-46), in place of Compound (S-23), as well as $0.6\times10^{-3}$ mol/mol Ag of Compound (I-1) and $0.9\times10^{-3}$ mol/mol Ag of Compound (F-1) to produce a final emulsion.

Emulsion A3 for the Yellow Coupler-Containing Layer

To a base emulsion prepared in the same manner as described for the magenta coupler-containing layer emulsion A2 was added $0.6\times10^{-4}$ mol/mol Ag each of Compound (S-40) and Compound (S-41), in place of Compound (S-46), but without addition of Compound (F-1) to produce a final emulsion.

Using same procedures as described for the preparation of Emulsions A1 through A3, silver halide Emulsions B1 through B3 and Emulsions C1 through C3 having an average grain sizes of 0.30 μm .and 0.70 μm, respectively, were prepared and coated Samples B and C were prepared.

For improving the image sharpness, these Samples A through C were coated with Compounds (D-3), (D-5) and (D-6) in amount of 0.020 $g/m^2$, 0.002 $g/m^2$ and 0.002 $g/m^2$ respectively.

The compounds used in the photographic materials descried in Table 1 above were as follows:
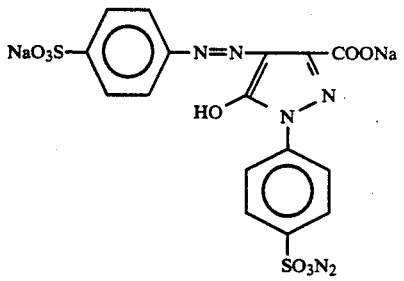
(D-1)
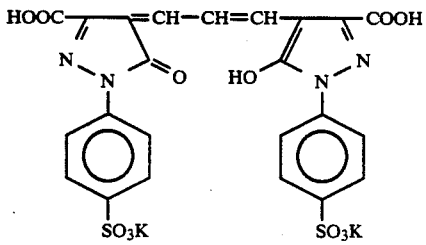
(D-2)
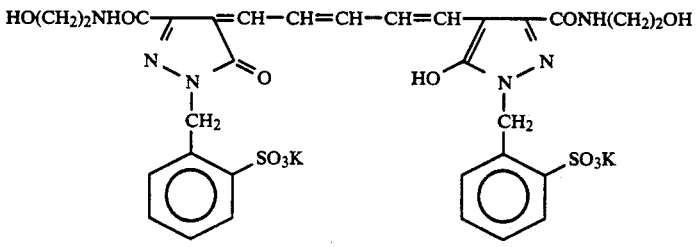
(D-3)
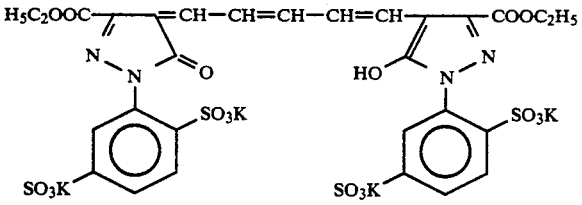
(D-4)
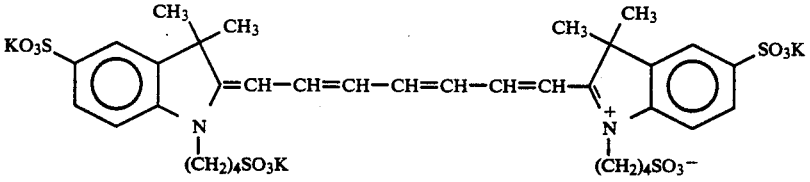
(D-5)
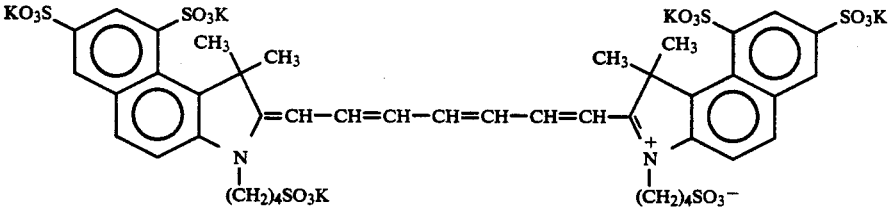
(D-6)
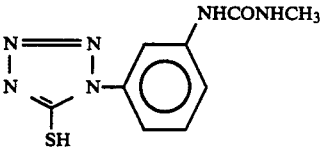
(I-1)

-continued
(F-1)
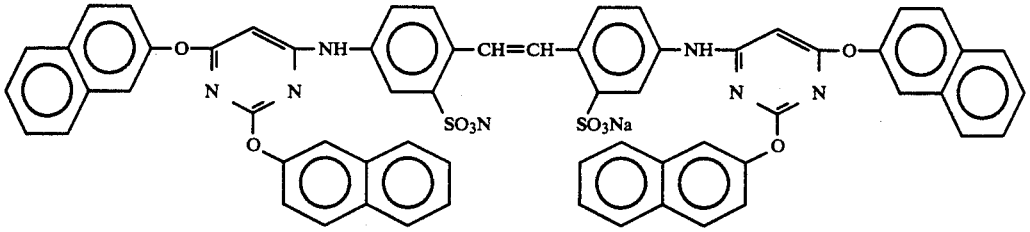
(Sol-1)
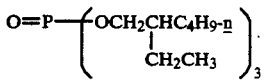
(Sol-2)
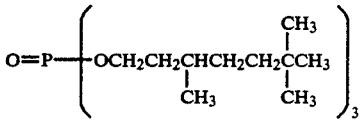
(Sol-3)
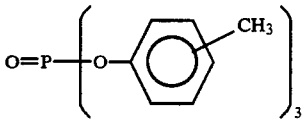
(Sol-4)
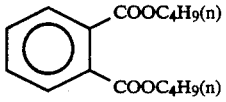
(Sol-5)
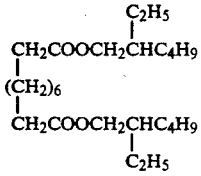
(Sol-6)
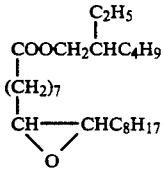
(Sol-7)
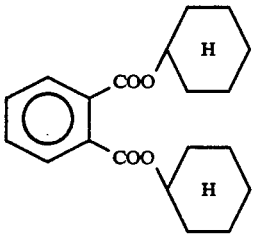
(H-1)
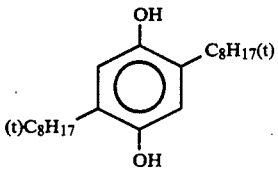

-continued
(H-2)
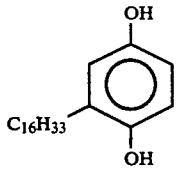
(H-3)
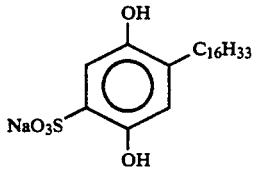
(H-4)
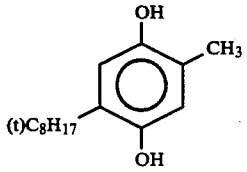
(H-6)
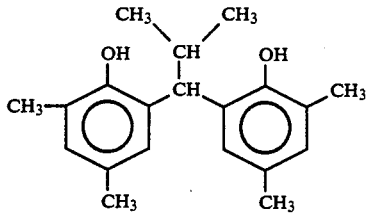
(X-1)
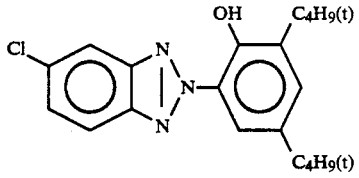
(X-2)
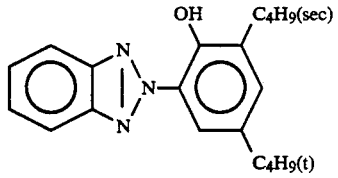
(X-3)
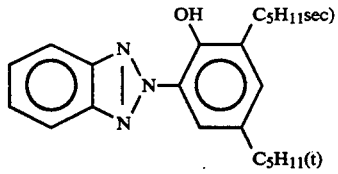
(X-4)
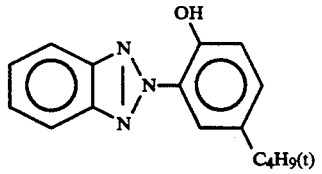
(A-1)
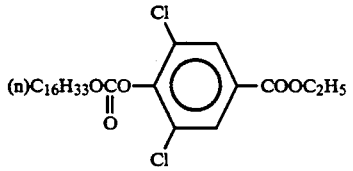

-continued

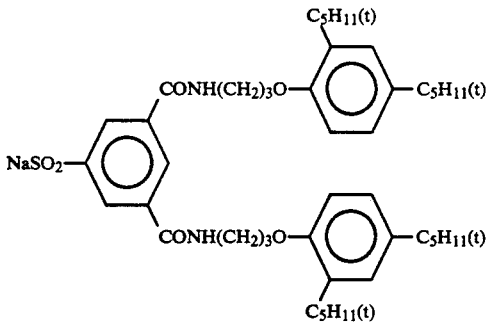

(B-1)

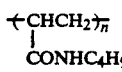

(P-1)

Average molecular weight: 60,000

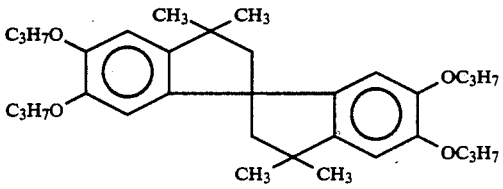

(E-1)

Similarly, Samples D through M were prepared with sensitivities varied by adjusting the silver amount and the coating amount of the dye as shown in Table 2 below. Emulsions A1 through A3 were used for Samples D, G, J and M, Emulsions B1 through B3 for Samples E, H and K, and Emulsions C1 through C3 for Samples F, I and L.

TABLE 2

| Sample | Silver ($g/m^2$) | | | Sensitivity (%) | | |
|---|---|---|---|---|---|---|
| | CL | ML | YL | CL | ML | YL |
| A | 0.21 | 0.13 | 0.30 | 30 | 45 | 60 |
| B | 0.21 | 0.13 | 0.30 | 30 | 45 | 60 |
| C | 0.21 | 0.13 | 0.30 | 30 | 45 | 60 |
| D | 0.21 | 0.24 | 0.30 | 30 | 45 | 60 |
| E | 0.21 | 0.24 | 0.30 | 30 | 45 | 60 |
| F | 0.21 | 0.24 | 0.30 | 30 | 45 | 60 |
| G | 0.21 | 0.13 | 0.30 | 50 | 70 | 80 |
| H | 0.21 | 0.13 | 0.30 | 50 | 70 | 80 |
| I | 0.21 | 0.13 | 0.30 | 50 | 70 | 80 |
| J | 0.21 | 0.24 | 0.30 | 50 | 70 | 80 |
| K | 0.21 | 0.24 | 0.30 | 50 | 70 | 80 |
| L | 0.21 | 0.24 | 0.30 | 50 | 70 | 80 |
| M | 0.24 | 0.13 | 0.43 | 30 | 45 | 60 |

In Table 2, CL, ML and YL represent the cyan, magenta and yellow dye-forming layers, respectively. The sensitivity value is the relative sensitivity value representing the decreased sensitivity in comparison with the absence of the dye.

The following three compounds were used in a mol ratio of 3:2:1 as a gelatin hardener.

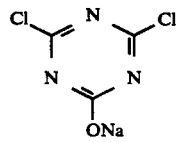

$CH_2NHCOCH_2SO_2CH{=}CH_2$
|
$CH_2NHCOCH_2SO_2CH{=}CH_2$

-continued $OCH_2SO_2CH{=}CH_2$
|
$CH_2SO_2CH{=}CH_2$

Using three different laser diodes with emission wavelengths of 670 nm, 750 nm and 810 nm, these coated Samples A through M were subjected to step-function light exposure using 1.0 density steps with electrically output-modulated light with scanning at 400 dpi and a mean exposure time of $2\times10^{-7}$ seconds per picture element and, then, immediately subjected to the following Color Development Process 1.

| Process | Temperature | Period |
|---|---|---|
| Color Development | 40° C. | 15 sec. |
| Bleach-Fix | 40° C. | 15 sec. |
| Rinse 1 | 40° C. | 15 sec. |
| Rinse 2 | 40° C. | 15 sec. |
| Rinse 3 | 40° C. | 15 sec. |
| Drying | 90° C. | 15 sec. |

The processing solutions used in the above procedures had the following compositions.

| | |
|---|---|
| Color Developer | |
| Ethylenediamine-N,N,N',N'-tetramethylenephosphonic acid | 3.0 g |
| N,N-Di(carboxymethyl)hydrazine | 4.5 g |
| N,N-Diethylhydroxylamine oxalate | 2.0 g |
| Triethanolamine | 8.5 g |
| Sodium sulfite | 0.14 g |
| Potassium chloride | 1.6 g |
| Potassium bromide | 0.01 g |
| Potassium carbonate | 25.0 g |
| N-Ethyl-N-(β-methanesulfonamidoethyl)-3-methyl-4-aminoaniline sulfate | 5.0 g |
| WHITEX-4 (Sumitomo Chemical) | 1.4 g |
| Water to make | 1000 ml |
| pH | 10.05 |
| Bleach-Fix Bath | |

-continued

| | |
|---|---|
| Ammonium thiosulfate (55 wt % aqueous solution) | 100 ml |
| Sodium sulfite | 17.0 g |
| Ammonium Fe(III)-ethylene-diaminetetraacetate | 55.0 g |
| Disodium ethylenediaminetetraacetate | 5.0 g |
| Ammonium bromide | 40.0 g |
| Acetic acid (glacial) | 9.0 g |
| Water to make | 1000 ml |
| pH | 5.80 |

Rinse

Deionized water (calcium ion <3 ppm, magnesium ion <2 ppm)

The changes in cyan, magenta and yellow densities at the respective density steps in each sample after the above Process 1 were measured with a microreflection densitometer and the degrees of sharpness were compared to the degrees of bleeding. The results obtained are shown in Tale 3 blow. The sharpness was represented by the gradient of a straight line connecting the point of minimum density +0.20 with the point of minimum density +0.05 and the result was expressed as a relative value with the values of the respective dye-forming layers of Sample A being used as 100.

TABLE 3

| Sample | CL | ML | YL | Remarks |
|---|---|---|---|---|
| A | 100 | 100 | 100 | Invention |
| B | 88 | 82 | 86 | Comp. Example |
| C | 86 | 82 | 84 | " |
| D | 94 | 96 | 94 | " |
| E | 84 | 82 | 82 | " |
| F | 82 | 82 | 80 | " |
| G | 72 | 68 | 70 | " |
| H | 66 | 62 | 66 | " |
| I | 68 | 66 | 68 | " |
| J | 74 | 74 | 74 | " |
| K | 78 | 76 | 76 | " |
| L | 76 | 76 | 74 | " |
| M | 90 | 92 | 88 | " |

Sample A according to the present invention is definitely superior in sharpness, with less bleeding, than any of Comparative Samples B through M. Moreover, comparison of Samples A through F with greater sensitivity decreases due to dye addition with Samples G through L with lesser degrees of sensitivity decrease shows that the improvement in sharpness over Sample G containing the silver halide emulsions of the invention having an average grain size of 0.46 μm is greater than the improvement in samples using silver halide emulsions having other average grain sizes and even greater than the degree of improvement of Sample D with an Ag amount of 0.24 g/m$^2$ for the magenta dye-forming layer over Sample J.

Furthermore, it was found that in the samples using silver halide emulsions with the average grain size of the invention, the degree of improvement in sharpness due to an increased amount of dye is greater when the silver coverage is small.

EXAMPLE 2

The Process 1 used in Example 1 was modified to Process 2 and the same Samples A through M as described in Example 1 were treated. Exposure was carried out in the same manner as in Example 1.

| Process | Temperature | Period |
|---|---|---|
| Color Development | 35° C. | 45 sec. |
| Bleach-Fix | 35° C. | 45 sec. |
| Rinse 1 | 25° C. | 30 sec. |
| Rinse 2 | 25° C. | 30 sec. |
| Rinse 3 | 25° C. | 30 sec. |
| Drying | 80° C. | 60 sec. |

As far as sensitivity was concerned, the same results as in Example 1 were obtained by Process 2.

EXAMPLE 3

A silver halide color photographic material was prepared in accordance with Table 4 below. This sample was designated Sample N.

TABLE 4

| Layer | Coating Composition | Coverage (g/m$^2$) |
|---|---|---|
| Seventh Layer (protective layer) | Gelatin | 1.30 |
| | Acryl-modified PVA (17% modification) | 0.15 |
| | Liquid paraffin | 0.05 |
| Sixth Layer (UV absorbing layer) | Gelatin | 0.65 |
| | Ultraviolet absorber (X-1) | 0.02 |
| | Ultraviolet absorber (X-2) | 0.09 |
| | Ultraviolet absorber (X-3) | 0.10 |
| | Color mixing inhibitor (H-1) | 0.02 |
| | Solvent (S-5) | 0.11 |
| Fifth Layer (red-sensitive layer) | Emulsion Kl (as Ag) | 0.24 |
| | Gelatin | 1.76 |
| | Polymer (P-1) | 0.53 |
| | Cyan coupler (C-2) | 0.07 |
| | Cyan coupler (C-5) | 0.12 |
| | Cyan coupler (C-4) | 0.09 |
| | Cyan coupler (C-3) | 0.07 |
| | Color image stabilizer (X-1) | 0.04 |
| | Color image stabilizer (X-2) | 0.05 |
| | Color image stabilizer (X-4) | 0.05 |
| | Color image stabilizer (A-1) | 0.01 |
| | Color image stabilizer (B-1) | 0.01 |
| | Color image stabilizer (H-4) | 0.01 |
| | Color image stabilizer (H-2) | 0.04 |
| | Solvent (Sol-6) | 0.11 |
| | Solvent (Sol-7) | 0.11 |
| Fourth Layer (UV absorbing layer) | Gelatin | 1.60 |
| | Ultraviolet absorber (X-1) | 0.06 |
| | Ultraviolet absorber (X-2) | 0.27 |
| | Ultraviolet absorber (X-3) | 0.29 |
| | Color mixing inhibitor (H-1) | 0.06 |
| | Solvent (Sol-5) | 0.26 |
| Third Layer (green-sensitive layer) | Emulsion K2 (as Ag) | 0.15 |
| | Gelatin | 1.60 |
| | Magenta coupler (M-13) | 0.22 |
| | Magenta coupler (M-15) | 0.08 |
| | Color image stabilizer(E-1) | 0.10 |
| | Color image stabilizer(A-1) | 0.08 |
| | Color image stabilizer (B-1) | 0.03 |
| | Color image stabilizer (H-3) | 0.01 |
| | Color image stailizer (H-6) | 0.02 |
| | Solvent (Sol-1) | 0.44 |
| | Solvent (Sol-3) | 0 22 |
| Second Layer (color mixing inhibition layer) | Gelatin | 1.30 |
| | Color mixing inhibitor (H-1) | 0.06 |
| | Solvent (Sol-3) | 0.12 |
| | Solvent (Sol-4) | 0.12 |
| First Layer (blue-sensitive layer) | Emulsion K3 (as Ag) | 0.27 |
| | Gelatin | 1.66 |
| | Polymer (P-1) | 0.16 |
| | Yellow coupler (Y-4) | 0.14 |
| | Yellow coupler (Y-6) | 0.18 |
| | Yellow coupler (Y-1) | 0.35 |
| | Color image stabilizer (H-4) | 0.01 |
| | Solvent (Sol-2) | 0.15 |
| | Solvent (Sol-6) | 0.14 |
| Support | $TiO_2$ 5 g/m$_2$(15 wt %)-containing polyethylene laminate sheet | |

The silver halide emulsions used for the respective layers were as follows.

Emulsion N1 for the Red-Sensitive Layer

In 1,000 ml of distilled water was dissolved 30 g of lime-processed gelatin at 40° C. and the solution was adjusted to pH 7.0. Then, 0.02 g of N,N'-dimethylimidazolidine-2-thione and 5.0 g of sodium chloride were added and the temperature was increased to 52.5° C. Then, a solution of 62.5 g of silver nitrate in 750 ml of distilled water and a solution of 21.5 g of sodium chloride in 500 ml of distilled water were added to the above-solution at a controlled temperature of 52.5° C. over a period of 40 minutes Thereafter, a solution of 62.5 g of silver nitrate in 500 ml of distilled water and a solution of 21.5 g of sodium chloride in 300 ml of distilled water were added at 52.5° C. over a 20 minute period with stirring. Electron microscopy of the resulting emulsion revealed cubic grains with an average edge length of about 0.47 μ and a coefficient of variation in grain size distribution of 0.14.

After the above emulsion was desalted and rinsed, 0.2 g of nucleic acid, $1\times10^{-4}$ mol/mol Ag of Compound (S-43) and 0.6 mol % silver halide equivalent of a monodisperse silver bromide emulsion with an average particle size of 0.05 μ (containing $2\times10^{-5}$ mol/mol Ag of dipotassium iridium hexachloride) were added. Then, the emulsion was chemically sensitized with about $2\times10^{-6}$ mol/mol Ag of triethylthiourea, followed by addition of $7\times10^{-4}$ mol/mol Ag of Compound (I-1) and $1.5\times10^{-3}$ mol/mol Ag of Compound (F-1).

Emulsion N2 for the Green-Sensitive Layer

In 1,000 ml of distilled water was dissolved 30 g of lime-processed gelatin at 40° C. and the solution was adjusted to pH 7.0. Then, 6.5 g of sodium chloride was added and the temperature was increased to 60° C. To this solution were added a solution of 62.5 g of silver nitrate in 750 ml of distilled water and a solution of 21.5 g of sodium chloride in 500 ml of distilled water at a controlled temperature of 60° C. over a period of 40 minutes. Thereafter, a solution of 62.5 g of silver nitrate in 500 ml of distilled water and a solution of 21.5 g of sodium chloride in 300 ml of distilled water were added at 60° C. over a period of 20 minutes.

Electron microscopy of the resulting emulsion revealed that it was composed of cubic grains with an average edge length of about 0.58 μ and a coefficient of variation in grain size distribution of 0.12.

After the above emulsion was desalted and rinsed, 0.2 g of nucleic acid, $4\times10^{-4}$ mol/mol Ag of Compound (S-76), $5\times10^{-5}$ mol/mol Ag of Compound (S-61) and 0.3 mol % silver halide equivalent of a monodisperse silver bromide emulsion with an average grain size of 0.05 μ (containing $2.5\times10^{-5}$ mol/mol Ag of dipotassium iridium hexachloride) were added. This emulsion was chemically sensitized with about $2.0\times10^{-6}$ mol/mol Ag of triethylthiourea, followed by addition of $0.8\times10^{-3}$ mol/mol Ag of Compound (I-1).

Emulsion N3 for the Blue-Sensitive Emulsion Layer

In 1,000 ml of distilled water was dissolved 20 g of lime-processed gelatin at 40° C. and the solution was adjusted to pH 3.8 with sulfuric acid. Then, 5.5 g of sodium chloride was added and the temperature was increased to 75° C. A solution of 12.5 g of silver nitrate in 150 ml of distilled water and a solution of 4.3 g of sodium chloride in 100 ml of distilled water were added to the above solution with stirring at a controlled temperature of 75° C. over a period of 30 minutes. Thereafter, a solution of 112.5 g of silver nitrate in 1,100 ml of distilled water and a solution of 38.7 g of sodium chloride in 650 ml of distilled water were added with stirring at 75° C. over a period of 40 minutes.

Electron microscopy of the resulting emulsion revealed that it was composed of cubic grains with an average edge length of about 0.82 μ and a coefficient of variation in grain size distribution of 0.11.

After the above emulsion was desalted and rinsed, 0.2 g of nucleic acid, $2\times10^{-3}$ mol/mol Ag of Compound (S-69), $2\times10^{-3}$ mol/mol Ag of Compound (S-71), and 0.4 mol % silver halide equivalent of a monodisperse silver bromide emulsion with an average grain size of 0.05 μ (containing $1\times10^{-5}$ mol/mol Ag of dipotassium iridium hexachloride) were added. The emulsion was then chemically sensitized with about $1.2\times10^{-6}$ mol/mol Ag of triethylthiourea, followed by addition of $9\times10^{-4}$ mol/mol Ag of Compound (I-1).

For improvement of image sharpness by prevention of irradiation, this sample was coated with compounds (D-1), (D-2), (D-3) and (D-4) in amounts of 0.008 g/m², 0.003 g/m², 0.016 g/m² and 0.040 g/m², respectively. The same gelatin hardener as used in Sample A of Example 1 was employed.

Furthermore, Emulsions N4 and N5 having average grain sizes of 0.30 μm and 0.70 μm were prepared in otherwise the same manner as in the preparation of the above silver halide Emulsion N2. By substituting these emulsions for Emulsion N2 in the Fifth Layer and varying the coating amounts of the dye and silver, coated samples shown in Table 5 were prepared. Emulsion N2 was used for Samples Q, T and W, Emulsion N4 for Samples 0, R, U and X, and Emulsion N5 for Samples P, S, V and Y.

TABLE 5

| | Silver (g/m²) | | | Sensitivity (%) | | |
|---|---|---|---|---|---|---|
| Sample | RL | GL | BL | RL | GL | BL |
| N | 0.19 | 0.15 | 0.27 | 25 | 45 | 45 |
| O | 0.19 | 0.15 | 0.27 | 25 | 45 | 45 |
| P | 0.19 | 0.15 | 0.27 | 25 | 45 | 45 |
| Q | 0.24 | 0.26 | 0.27 | 25 | 45 | 45 |
| R | 0.24 | 0.26 | 0.27 | 25 | 45 | 45 |
| S | 0.24 | 0.26 | 0.27 | 25 | 45 | 45 |
| T | 0.19 | 0.15 | 0.27 | 55 | 70 | 90 |
| U | 0.19 | 0.15 | 0.27 | 55 | 70 | 90 |
| V | 0.19 | 0.15 | 0.27 | 55 | 70 | 90 |
| W | 0.24 | 0.26 | 0.27 | 55 | 70 | 90 |
| X | 0.24 | 0.26 | 0.27 | 55 | 70 | 90 |
| Y | 0.24 | 0.26 | 0.27 | 55 | 70 | 90 |

These Samples N through Y were subjected to white light exposure through blue, green and red filters and a CTF chart with a space frequency of 10 cm/mm and, then subjected to the same development process as that described in Example 2.

The respective color densities of each of the processed samples were measured with a microreflection densitometer. The CTF values thus found are shown in Table 6 below. Each CTF value is a relative value with the value at a space frequency of 0 cm/mm being taken as one.

TABLE 6

| Sample | Red-Sensitive Layer | Green-Sensitive Layer | Blue-Sensitive Layer | Remarks |
|---|---|---|---|---|
| N | 0.60 | 0.59 | 0.59 | Invention |
| O | 0.54 | 0.56 | 0.56 | Comp. Example |

TABLE 6-continued

| Sample | Red-Sensitive Layer | Green-Sensitive Layer | Blue-Sensitive Layer | Remarks |
|---|---|---|---|---|
| P | 0.53 | 0.55 | 0.56 | " |
| Q | 0.53 | 0.54 | 0.53 | " |
| R | 0.51 | 0.51 | 0.52 | " |
| S | 0.49 | 0.50 | 0.52 | " |
| T | 0.41 | 0.43 | 0.46 | " |
| U | 0.40 | 0.42 | 0.44 | " |
| V | 0.39 | 0.41 | 0.43 | " |
| W | 0.42 | 0.44 | 0.46 | " |
| X | 0.41 | 0.42 | 0.44 | " |
| Y | 0.41 | 0.43 | 0.44 | " |

It is evident from the results in Table 6 that Sample N according to the present invention exhibited high CTF values as compared with Comparative Samples O through Y which are outside the scope of the invention.

Comparison of Samples N through S which were dyed to the extent of the present invention with Samples T through Y which were not dyed to the extent of the invention reveals that in comparison with the gain in CTF of Sample N, wherein silver halide emulsions having an average grain size within the range of the invention were used in the range of silver amount of the invention, over Sample T, gains in CTF of the other samples are definitely smaller. It is really surprising that intensive dyeing leads to a marked improvement in sharpness only in the system thus far described and the advantage of the silver halide color photographic material of the invention is quite apparent.

EXAMPLE 4

By varying the coating amount of Sample N prepared as described in Example 3, a sample in which the sensitivity of the red-sensitive layer was set at 8%, a sample in which the sensitivity of the green-sensitive layer was set at 15% and a sample in which the sensitivity of the blue-sensitive layer was set at 25% were prepared and the CTF values were determined in the same manner as described in Example 3. In these samples, the CTF values of the red-sensitive layer, green-sensitive layer and blue-sensitive layer had been further improved than in Sample N but when the resolution chart was printed using a gray light exposure, undesirable bleeding due to color offset was observed, with the interlayer balance of sharpness having been disturbed. The importance of interlayer sensitivity setting, that is to say the setting of the dyeing amount, can be well understood.

It will be apparent from the above description that the present invention provides a silver halide photographic material of low silver amount insuring satisfactory image sharpness. This silver halide photographic emulsion is excellent in rapid processability, too, and the invention provides a photosensitive material which insures excellent integral characteristics in such applications as color papers and infrared-sensitized color print photosensitive materials.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a reflective support and coated thereon at least one each of a cyan dye-forming silver halide emulsion layer, a magenta dye-forming silver halide emulsion layer and a yellow dye-forming silver halide emulsion layer, each of said emulsion layers containing substantially silver iodide-free silver chloride or silver chlorobromide and respectively having spectral sensitivity peaks in different wavelength regions, at least two of said emulsion layers containing silver halide grains having an average grain size of 0.35 μm to 0.65 μm and at least one of said emulsion layers having a silver halide content of 0.19 g Ag/m$^2$ or less, a third emulsion layer containing silver halide grains having a grain size of from 0.05 μm to 2 μm, the total silver amount in all the silver halide emulsion layers being 0.78 g/m$^2$ to 0.2 g/m$^2$, and a water-soluble or bleachable dye being available on said support in such an amount that the sensitivity of the silver halide emulsion layer having a sensitivity peak at the longest wavelength is reduced to 35 to 10% of the sensitivity in the absence of said water-soluble or bleachable dye, the sensitivity of the silver halide emulsion layer having a sensitivity peak at the second longest wavelength is reduced to 50 to 20% of the sensitivity in the absence of said water-soluble or bleachable dye, and the sensitivity of the silver halide emulsion layer having sensitivity peak at the shortest wavelength is reduced to 70 to 30% of the sensitivity in the absence of said water-soluble or bleachable dye, said water-soluble or bleachable dye is represented by general formula (A):

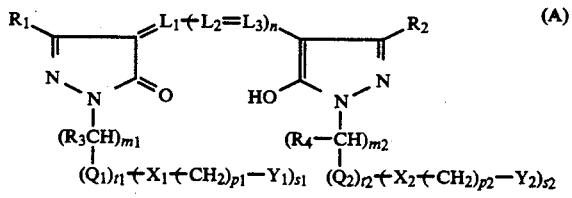

(A)

wherein $R_1$ and $R_2$ each represents —COOR$_5$ or

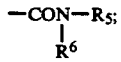

$R_3$ and $R_4$ each represents a hydrogen atom or an alkyl or substituted alkyl group; $R_5$ and $R_6$ each represents a hydrogen atom, an alkyl or substituted alkyl group, or an aryl or substituted aryl group; $Q_1$ and $q_2$ each represents an aryl group; $X_1$ and $X_2$ each represents a bond or a divalent linking group; $Y_1$ and $Y_2$ each represents a sulfo group or a carboxyl group; $L_1$, $L_2$ and $L_3$ each represents a methine group $m_1$ and $M_2$ each represents 0, 1 or 2; n represents 0, 1 or 2, $p_1$ and $p_2$ each represents 0, 1, 2, 3 or 4; $s_1$ and $s_2$ each represents 1 or 2; $t_1$ and $t_2$ each represents 0 or 1; provided that $m_1$, $p_1$ and $t_1$ or $m_2$, $p_2$ and $t_2$ are not simultaneously equal to 0.

2. The silver halide color photographic material of claim 1, wherein the reflective support is a support covered at least on one side thereof with a water-resistant resin layer and/or a hydrophilic colloid layer containing at least 13 weight percent of titanium dioxide based on the total of the resin layer, the hydrophilic colloid layer and the titanium dioxide.

3. The silver halide color photographic material of claim 1 or 2, wherein the cyan and/or magenta dye-forming silver halide emulsion layer contains a pyrazoloazole coupler.

4. The silver halide color photographic material of claim 1, wherein the silver halide in at least one of said emulsion layers has an average grain size of 0.40 μm to 0.60 μm.

5. The silver halide color photographic material of claim 1, wherein the silver halide content in at least one of said emulsion layers containing said water-soluble or bleachable dye is 0.16 g $Ag/m^2$ or less.

6. The silver halide color photographic material of claim 4, wherein the silver halide content in at least one of said emulsion layers containing said water-soluble or bleachable dye is 0.13 g $Ag/m^2$ or less.

7. The silver halide color photographic material of claim 2, wherein the coefficient of variation in the percentage area where the titanium dioxide is present per unit surface area of the support is 0.20 or less.

8. The silver halide color photographic material of claim 1, wherein the silver halide in the photosensitive layers contains no silver iodide.

9. The silver halide color photographic material of claim 1, wherein the silver halide in the photosensitive layers is silver chloride or silver chlorobromide containing at least 96 mol percent silver chloride.

10. The silver halide color photographic material of claim 1, wherein the silver bromide is present in a localized phase in said silver halide grains.

11. The silver halide color photographic material of claim 1, wherein the silver halide in the photosensitive layers is chemically sensitized.

* * * * *